US010094210B2

(12) United States Patent
Hareland et al.

(10) Patent No.: US 10,094,210 B2
(45) Date of Patent: Oct. 9, 2018

(54) DRILLING SYSTEM

(71) Applicant: ROCSOL TECHNOLOGIES INC., Calgary (CA)

(72) Inventors: Geir Hareland, Calgary (CA); Mauricio Jose Farinas Moya, Houston, TX (US); Prasad Baloo Kerkar, Houston, TX (US); Ernesto Rafael Fonseca Ocampos, Houston, TX (US)

(73) Assignee: Rocsol Technologies Inc., Calgary (CA)

( * ) Notice: Subject to any disclaimer, the term of this patent is extended or adjusted under 35 U.S.C. 154(b) by 976 days.

(21) Appl. No.: 14/043,564

(22) Filed: Oct. 1, 2013

(65) Prior Publication Data

US 2015/0090498 A1 Apr. 2, 2015

(51) Int. Cl.

| | |
|---|---|
| ***E21B 49/00*** | (2006.01) |
| ***E21B 12/02*** | (2006.01) |
| ***E21B 3/00*** | (2006.01) |
| ***E21B 45/00*** | (2006.01) |
| ***E21B 43/26*** | (2006.01) |
| ***E21B 44/00*** | (2006.01) |

(52) U.S. Cl.

CPC ..... *E21B 45/00* (2013.01); *E21B 3/00* (2013.01); *E21B 43/26* (2013.01); *E21B 44/00* (2013.01)

(58) Field of Classification Search

CPC ..... E21B 49/003; E21B 12/02; E21B 3/00; E21B 45/00; E21B 44/00; E21B 43/26

USPC ..... 703/10; 702/6

See application file for complete search history.

(56) References Cited

U.S. PATENT DOCUMENTS

| | | | | |
|---|---|---|---|---|
| 4,760,735 | A | 8/1988 | Sheppard et al. | |
| 4,914,591 | A | 4/1990 | Warren et al. | |
| 5,305,836 | A * | 4/1994 | Holbrook | E21B 12/02 175/26 |
| 5,415,030 | A * | 5/1995 | Jogi | E21B 12/02 175/39 |
| 5,679,894 | A | 10/1997 | Kruger et al. | |
| 5,996,714 | A * | 12/1999 | Massa | E21B 10/42 175/413 |

(Continued)

FOREIGN PATENT DOCUMENTS

| | | |
|---|---|---|
| CA | 2009654 | 2/1991 |
| GB | 2270385 | 3/1994 |

(Continued)

OTHER PUBLICATIONS

Rashidi "Performance, Simulation and Field Application Modeling of Rollercone and PDC Drill Bits". University of Calgary. 2011. 133 pages.*

(Continued)

*Primary Examiner* — Eunhee Kim

(74) *Attorney, Agent, or Firm* — Anthony R. Lambert

(57) ABSTRACT

Rock strength is estimated during drilling using a rate of penetration model or a modified mechanical specific energy models. The rock strength estimate can be used in conducting further drilling, for example by a drilling system. Drilling parameters may be altered as a result of determining rock strength, for example to avoid undesirable trending fractures, such as extensive vertical fractures.

19 Claims, 20 Drawing Sheets

(56) References Cited

U.S. PATENT DOCUMENTS

| | | | | |
|---|---|---|---|---|
| 6,516,293 | B1 * | 2/2003 | Huang | E21B 10/16 175/331 |
| 7,044,238 | B2 | 5/2006 | Hutchison | |
| 7,412,331 | B2 | 8/2008 | Calhoun et al. | |
| 7,555,391 | B2 | 6/2009 | Gleitman | |
| 8,360,171 | B2 | 1/2013 | Boone et al. | |
| 8,401,831 | B2 | 3/2013 | Tang et al. | |
| 8,498,853 | B2 | 7/2013 | Crawford et al. | |
| 8,949,098 | B2 | 2/2015 | King | |
| 8,990,021 | B2 | 3/2015 | Jeffyres | |
| 9,022,140 | B2 | 5/2015 | Marx et al. | |
| 9,482,055 | B2 | 11/2016 | Huang | |
| 2004/0182606 | A1 * | 9/2004 | Goldman | E21B 12/02 175/39 |
| 2005/0019418 | A1 | 1/2005 | Crutchfield et al. | |
| 2009/0016412 | A1 | 6/2009 | Bordakov | |
| 2009/0173539 | A1 | 7/2009 | Mock et al. | |
| 2009/0250264 | A1 | 10/2009 | Dupreist | |
| 2010/0133008 | A1 | 6/2010 | Gawski et al. | |
| 2010/0319992 | A1 | 12/2010 | Trinh et al. | |
| 2011/0011646 | A1 | 1/2011 | Giroux et al. | |
| 2011/0048806 | A1 | 3/2011 | Fincher et al. | |
| 2011/0174541 | A1 | 7/2011 | Strachan et al. | |
| 2011/0186353 | A1 | 8/2011 | Turner et al. | |
| 2012/0261190 | A1 | 10/2012 | Krueger et al. | |
| 2014/0027175 | A1 | 1/2014 | Ringer et al. | |
| 2014/0196949 | A1 | 7/2014 | Hareland | |
| 2014/0291023 | A1 | 10/2014 | Edbury | |

FOREIGN PATENT DOCUMENTS

| | | |
|---|---|---|
| GB | 2396697 | 6/2004 |
| WO | 2013000094 | 1/2013 |

OTHER PUBLICATIONS

International Search Report for PCT/US2014/058677; dated Jan. 6, 2015; 10pp.

Behrad Rashidi; Performance, Simulation, and Field Application Modeling of Rollercone and PDC Drill Bits (PhD thesis); Jan. 2011; 133pp; University of Calgary; Calgary, Canada.

B. Rashidi, G. Hareland, Z. Wu; "New Approach in Real-Time Bit Wear Production" (conference paper); SPE Paper No. 136008-PP; Nov. 2010; 6pp; Society of Petroleum Engineers.

F. Shirkavand, G. Hareland, B. S. Aadnoy; Rock Mechanical Modelling for a Underbalanced Drilling Rate of Penetration Prediction (conference paper); ARMA 09-97; Jun. 2009; 5pp; American Rock Mechanics Association.

B. Rashidi, G. Hareland, R. Nygaard; "Real-Time Drill Bit Wear Predicition by Combining Rock Energy and Drilling Strength Concepts" (conference paper); SPE Paper No. 117109-PP; Nov. 2008; 11pp; Society of Petroleum Engineers.

P.K.Dutta; A Theory of Percussive Drill Bit Penetration; Inc. J. Rock Mech. Min.Sci.; vol. 9; pp. 543-567; 1972.

Hareland, G., Drilling Optimization Simulation Reduces Drilling Cost, Society of Petroleum Engineers Distinguished Lecturer Program, Oct. 2009, 27 Pages.

Hareland, G., Nygaard, R., Calculating unconfined rock strength from drilling data, American Rock Mechanics Association, 2007, 7 Pages.

Hareland, G., Hoberock, L.L., Use of drilling parameters to predict in-situ stress bounds, SPE/IADC 25727, 1993, p. 457-p. 471.

Rampersad, P., Hareland, G., Pairintra, T., Drilling optimization of an oil or gas field, SPE 26949, 1993, p. 485-p. 492.

Rampersad, P., Hareland, G., Boonyapaluk, P., Drilling optimization using drilling data and available technology, SPE 27034, 1994, p. 317-p. 325.

Nygaard, R., Hareland, G., Application of rock strength in drilling evaluation, SPE 106573, 2007, 7 Pages.

A.T. Bourgoyne Jr: A Multiple Regression Approach to Optimal Drilling and Abnormal Pressure Detection; Aug. 1974; Transactions; vol. 257; p. 371-384.

Al-Bani, F. et al. Optimizing powered rotary steering through better understanding of the downhole environment, Offshore Technology Conference, 2007, Texas.

Kelessidis, V.C. and Dalamarinis, P. Monitoring drilling bit parameters allows optimization of drilling rates, International Multidisciplinary Scientific Geo-Conference & Expo, 2009, Bulgaria.

Wolcott, D.S. et al, Lithology determination using downhole bit mechanics data, SPE annual technical conference and exhibition, 1993, Texas.

Aadnoy, BS, and Andersen, K. Design of oil wells using analytical friction models, Journal of Petroleum Science and Engineering, 2001, 53-71.

* cited by examiner $$ROP_{actual} = k_1 . HSI^{K_2}$$

DRILLING SYSTEM

FIELD

The invention is related to a controlling system for directional drilling and fracturing of oil and gas wells.

BACKGROUND

In the drilling industry, in the absence of downhole measurements, the hookload and surface torque measurements are used to calculate weight on the bit and the bit torque. To apply weight on the bit, it is required to apply some portion of drillstring weight on the bit. The weight on the bit is calculated based on the difference between the hookload values when drillstring is off and on bottom. The surface weight on the bit could be the true value, if the well is vertical and the axial friction force between drillstring and the wellbore is negligible. When the well deviate from vertical straight line, the surface and downhole weight on the bit may not be the same due to axial friction force between drillstring and the wellbore. The same happens for bit torque calculation. The bit torque is estimated from difference between surface torque measurements while drilling bit is off and on bottom. An improved method of calculating downhole weight on bit and using this information in the drilling process is required.

Drilling data has been used in rate of penetration (ROP) models to predict rock strength since the 1980s. The development of ROP models has been ongoing for decades and since the 1980s there exist ROP models for tricone, PDC and natural diamond bits. These ROP models have mostly been verified for some bit types with laboratory drilling data and in some cases data collected from the field.

SUMMARY

In an embodiment, there is provided a method of drilling a well or fracturing a formation, the method comprising the steps of drilling with a drilling system by rotating a bit, providing a model for calculating rate of penetration of the bit through the rock being drilled through, the model including the strength of the rock and known or estimated parameters, measuring or estimating a value of the rate of penetration of the bit, estimating the strength of the rock according to a value of the strength of the rock required to cause the model to calculate the rate of penetration of the bit to have the measured or estimated value given the known or estimated parameters and setting drilling or fracturing parameters according to the estimated rock strength. The known or estimated parameters may include a measure of bit wear, and the model may include a proportionality of the rate of penetration through the rock to a function of the measure of bit wear. A rate of change of the measure of bit wear may be measured based on the estimated strength of the rock. The steps of the method may be repeated at a subsequent point in time, estimating the bit wear at the subsequent point in time using the estimated rate of change of the measure of bit wear.

BRIEF DESCRIPTION OF THE DRAWINGS

Embodiments will now be described with reference to the figures, in which like reference characters denote like elements, by way of example, and in which.

DETAILED DESCRIPTION OF PREFERRED EMBODIMENTS

Figure 1:
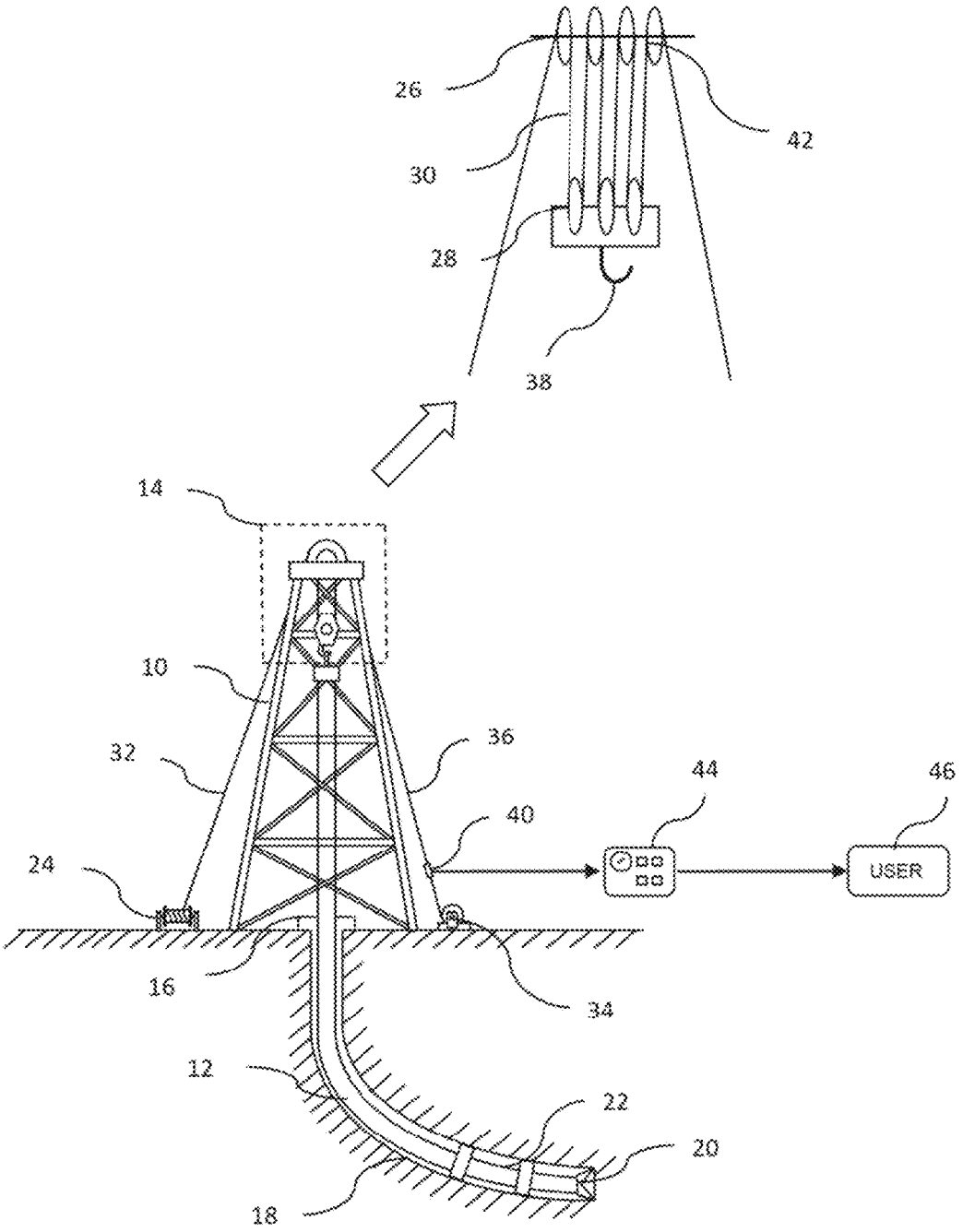
FIG. 1 is a schematic illustration of drilling rig that shows the block and tackle system. The drilling system is connected to deadline or any other hookload measurement system to estimate downhole weight on the bit.

The embodiments disclosed here provide mechanisms for improvement of drilling and fracturing underground formations. In various embodiments, the mechanisms are implemented at least partially through an drilling system that controls drilling system components and that receives information on drilling conditions from drilling system components. The drilling system may be, for example, an auto-driller. The drilling system includes a processor that may be configured, by various means such as software, firmware and hardware, to calculate or estimate true downhole weight on bit (DWOB) by for example a) determining the static weight of drillstring; b) determining the axial friction coefficient including pipe rotation effect; c) determining the effect of downhole weight on the bit on value of axial friction force during drilling; d) determining downhole weight on the bit using axial friction coefficient and surface hookload measurements. Any of the various embodiments of the drilling system disclosed in this document may use finite element or difference methods or an analytical solution to do the calculations. Any of the disclosed models or calculations may be implemented in the drilling system to control drilling or fracturing.

The true DWOB produces the required or manufacturer recommended and/or simulated optimum or near optimum DWOB which may be used to produce improved rate of penetration (ROP). A better prediction of rock strength (RS) may also be obtained based on inverted ROP models while drilling or in a post analysis mode. The RS may bring a more accurate and safer mud weight window to avoid wellbore collapse and fracturing, thus controlling mud weight may be an action taken as a result of estimation of the DWOB. The RS may also be used to optimize or at least improve operating drilling parameters such as hookload/DWOB, RPM, bit design and properly predict bit wear which is a strong function of DWOB in drilling simulators. In addition, the RS may be used to more accurately optimize current drilling operations and/or future wells in the area. The more accurately predicted RS can also be used to correlate to Youngs modulus (E) which in conjunction with RS can be used to determine the optimal locations to perform hydraulic fracturing in horizontal unconventional reservoirs.

In a further embodiment, the drilling system may be configured to calculate downhole torque on bit (DTOB) a) determining the rotational friction force while drilling bit is off bottom; b) determining the rotational friction coefficient including axial pipe movement effect from surface torque measurements while bit is off bottom; c) determining the effect of downhole weight on the bit on value of rotational friction force during drilling; d) determining downhole bit torque by using rotational friction coefficient and estimated downhole weight on the bit. The approach herein can use either finite element or difference methods or an analytical solution to do the calculations in the above approach. The true or estimated DTOB may be used for more accurate tooth wear prediction and used for real-time monitoring bearing wear, which gives drilling engineers reliable recommendation when to pull out the bit off the bottom and avoid bit failure and lost bearing in the hole.

The drilling system system may function independently of the drilling operator or driller ("black box" operation), and the driller sees the surface weight on the bit and then the system automatically adjust the surface WOB so that the down hole WOB can be accurate. The correct DWOB can give the optimal or near optimal WOB desired and other operating conditions for improvement of the overall or global ROP and minimize the $/ft.

In various embodiments, the drilling system may display both surface WOB (from hook load measurements) and down hole WOB (estimated from the method) for the driller. This will also benefit the driller get more accurate founder points (WOB when ROP no longer increase) when drill-off tests are being carried out.

The drilling system may learn from the surface measured data as a well is being drilled ahead by calibrating both axial and rotational friction coefficients. The friction coefficients can in addition help drilling engineers identify if drilling problems such as string sticking or insufficient hole cleaning is present, and may enable the drilling engineers to avoid pipe sticking.

The drilling system system may be used in both rotating and sliding drilling mode with a mud driven motor or with a rotary steerable system.

In rotary steerable drilling operations, no downhole weight on bit measurements may be required if the drilling system system calibrates itself from surface hookload measurements.

The drilling system may be used to calculate the static weight of drillstring using survey data, drillstring specification and local buoyancy factor at any bit depth, for example as provided by a mud logging unit on the rig site.

In some embodiments of the drilling system, the axial friction coefficient including the drillstring rotation effect is estimated by using the friction model from an improved surface measured hookload. For example, the last several off-bottom time based data points (excluding abnormal points) may be selected to calculate the friction coefficient using the hookload and SWOB of those points.

An improved measured hookload may for example be obtained while the bit is moving downwardly, and sufficiently close to the bottom that the drillstring rotation is for practical purposes the same as expected while drilling ahead in a new section.

In various embodiments of the drilling system, different equations may be used for calculating weight on bit or bit torque depending on whether a portion or element of the drillstring in a curved section is in compression or tension.

The drilling system may calculate the hookload by using axial friction coefficient and estimating the weight on the bit. The calculated hookload is compared with measured hookload value and if the difference between these values is negligible, the estimated value for weight on the bit is taken as downhole weight on the bit. If the difference is not negligible, another value will be estimated for weight on the bit and this procedure is repeated to get the true downhole weight on the bit.

For bit torque calculations, the rotational friction coefficient including the drillstring axial movement effect may be estimated by using the friction model from an improved measured surface torque while bit is off bottom and there is no torque at the bit. An improved measured surface torque may be found while the bit is moving downwardly and sufficiently close to the bottom that the drillstring rotation is the same as expected when drilling ahead in the next section. Using the rotational friction coefficient and estimated downhole weight on the bit from the drilling system, the estimated rotational friction force may be deducted from measured surface torque to find the downhole bit torque. The changes in downhole weight on the bit will change the rotational friction force which affects the value of the bit torque.

Use of the drilling system may provide an early real-time detection of the predicted trends (DWOB, friction factor) associated with some drilling dysfunctions (bit bouncing, stick-slip, lateral vibration, pipe sticking), which may enable the driller to take early corrective action to minimize escalation of the issue and therefore minimize the potential to induce coupling and catastrophic drill string integrity failures.

FIG. 1 shows the schematic diagram of a drilling rig. The drilling rig includes a derrick 10, drillstring 12, hoisting system, rotating system 16, circulating system (not shown) and power system (not shown). Derrick 10 supports hoisting system and rotating system 16 which operate by power system (not shown). A drillstring 12 includes a series of drill pipe joints which connected downwardly from surface into the borehole 18. A drilling bit 20 is attached to the end of drillstring that is called bottom hole assembly, BHA, 22. The BHA does many functions such as providing weight on the bit, torque at the bit by downhole motor etc. The rotating system 16 may include the rotary table 16 or top drive (not shown) to rotate drillstring 12 at the surface to rotate drilling bit 20 at the bottom where it impacts the formation being drilled. The hoisting system includes drawworks 24 and block and tackle system 14. The drawworks 24 control the weight on the drilling bit 20 during drilling operation and raise and lower drillstring 12 through the wellbore. The block and tackle system 14 comprised of crown block 26, travelling block 28 and drilling line 30. If the number of drilling lines in the block and tackle system 14 increase, the tension in drilling lines 28 will decrease which provide the higher load capacity for the hoisting system.

The drilling line 30 is connected to drawworks 24 from one end which is called fast line 32 and from other end connected to deadline anchor or wheel 34 which is called the dead line 36. To measure the loads applied on the hook 38 by drillstring weight 12 and movement through the wellbore 18, the hydraulic cell 40 is connected to deadline 36 to measure the tension in drilling line 30. For hookload measurement, the measured tension in the deadline should be multiplied by the number of drilling line 30 between the sheaves 42 in block and tackle system 14. The tension in the deadline 36 is not true value due to friction between the drilling line 30 and the sheaves 42. The true value can be calculated by considering the friction in block and tackle system 14. When some weight of drillstring 12 applies on the drilling bit 20, a reduction in deadline 36 tensions is observed. In drilling industry based on industry method this reduction is considered as surface weight on the bit which is not usually equal to downhole weight on the bit. The real-time hookload data should be transferred into drilling system system 44 for further treatment to obtain the downhole weight on the bit. Also drilling system can calculate the downhole bit torque which results from surface rotation. The real time surface torque should be sent to drilling system system 44 for calculating downhole torque at the bit. After calculating downhole weight on the bit and bit torque, they will be available for users 46 for different purposes such as drilling optimization and real-time drilling analysis.

Figure 2A:
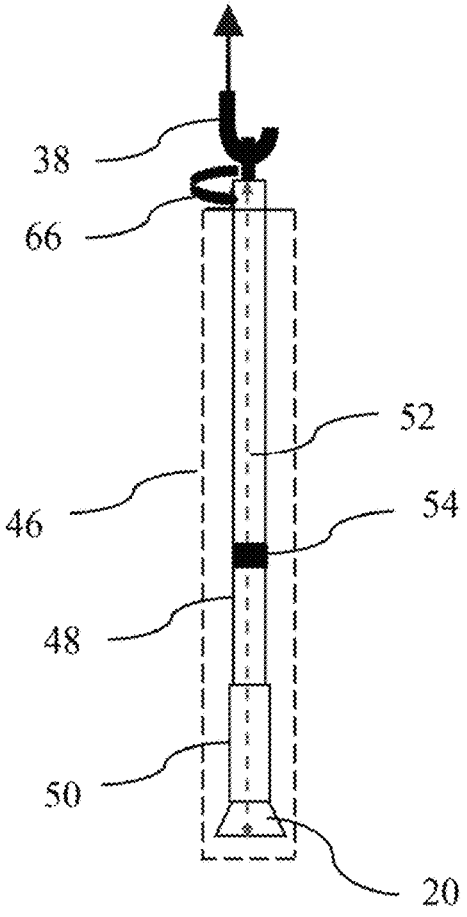
FIGS. 2A and 2B are respectively schematic descriptions of drillstring moving downwardly in a vertical well while the bit is off and on bottom respectively. The axial and rotational friction forces between drillstring and the wellbore while bit is off and on bottom are negligible.

FIG. 2*a* illustrates in schematic way a drillstring 12 in a vertical wellbore 46 with a hook 38 at the top. The drillstring is hung from the hook 38 which mostly consists of drillpipe 48 and the lower end of the drillstring called bottom hole assembly 50 that carries a drilling bit 20. The borehole is being drilled and extends downwardly from the surface. In FIG. 2*a* the drilling bit is off bottom and entire load of drillstring applies on the hook 38. In this condition, the entire drillstring will be in tension 52, the minimum tension is at the drilling bit and maximum tension will be at the surface. Also there is negligible contact between drillstring 12 and the vertical wellbore 46 during drillstring 12 rotations which means the friction force can be neglected. For a drillstring element 54 in a vertical wellbore 46, the tension force balance can be written as follow:

$$F_{top}=F_{bottom}+\beta\times SW \quad (1)$$

Where $F_{top}$: Force at the top of drillstring element $F_{bottom}$: Force at the bottom of drillstring element $\beta$: Buoyancy factor SW: Static weight of the drillstring element To calculate the tension at the hook 38, drillstring 12 is divided to n number of elements and calculation starts from drilling bit 20 to the surface. Please note, in underbalanced drilling, the buoyancy factor is dynamic parameter which will vary along the drillstring 12 by changing the pressure, temperature, drilling cutting rate and gas influx etc.

Figure 2B:
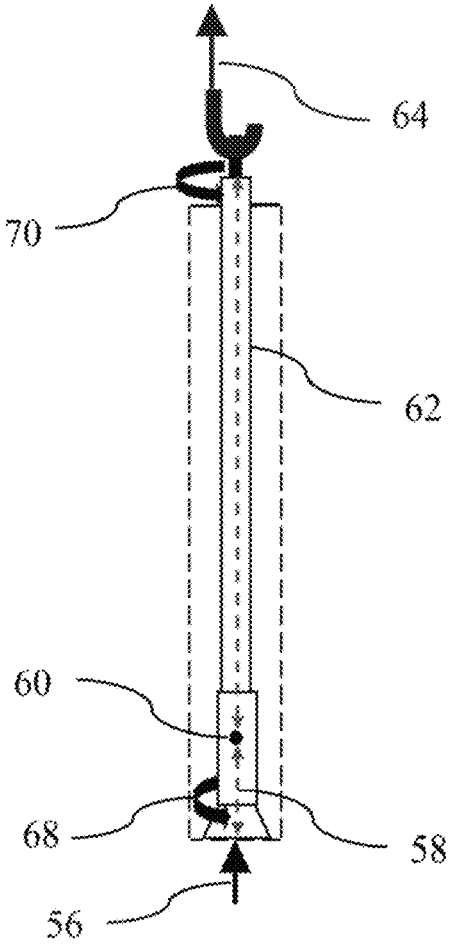

FIG. 2*b* shows the drillstring in on bottom position. Once some weight of drillstring applies on drilling bit, WOB 56, some length of drillstring will be in compression 58 beginning from bit to neutral point 60. In the neutral point the compression switches to tension 62 for the rest of drillstring to the surface. Obviously, the hook load 64 will be smaller once the weight applies on drilling bit. In this scenario, the weight on the bit 56 is recorded from the difference between the hook load values when drilling bit is off and on bottom. The calculated surface weight on the bit 56 will be the same as what applies downhole by neglecting the minor friction in the vertical well 46. The force balance at each element can be written as follow:

$$F_{top}=(F_{bottom})_{DWOB}+\beta\times SW \quad (2)$$

When the bit is off bottom, the surface torque 66 value is negligible due to minor contact between drillstring and the vertical wellbore 46. Once the bit goes on bottom for drilling and applies weight on the bit 56, an increase in value of surface toque 70 can be observed due to torque on the bit 68. To calculate bit torque 68 from surface measurements, the difference between surface torques 66 & 70 while bit is off and on bottom should be calculated.

Figure 3A:
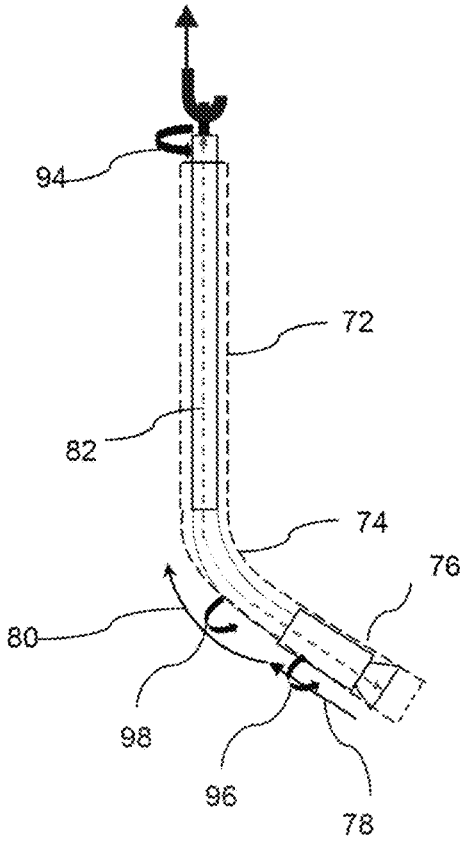
FIGS. 3A and 3B shows respectively the schematics of drillstring off-bottom and on bottom while moving downwardly in a well with the geometry of vertical, build-up and the straight inclined sections. The axial and rotational friction forces in the build-up section will be decreased applying some weight on the bit FIGS. 4A and 4B respectively illustrates the drillstring off-bottom and on bottom along a horizontal well which is pushing toward the bottom. The axial and rotational friction forces in the curved section will be decreased while applying some weight on the bit.

FIG. 3*a* shows a drillstring in a deviated wellbore which consist of vertical 72, build-up 74 and straight inclined 76 sections. In the build-up 74 and straight inclined 76 sections, there is contact between drillstring and the wellbore which results in friction force 78&80 against the pipe movement. The nature of friction in these two sections is different. In this scenario, the bit is off bottom and entire drillstring is in tension 82. When the axial friction forces calculations start from drilling bit upwardly, in the straight inclined section 76, the tension will not have any contribution in axial friction force 78. But when build up section 74 begins, the tension at this point will have great contribution in the friction force 80. It means, for a drillstring element in the straight inclined 76, the friction force 78 only depends on the weight of element which applies normally on the contact area but in the build-up section 74, the friction force 80 mostly depends on the tension at the bottom of the element and also the normal weight of drillstring element. The following is the general force balance for each element along drillstring.

$$F_{top}=F_{bottom}+\beta\times\mathrm{SW}-\mathrm{Friction}_{weight}-[\mathrm{Friction}_{tension}\text{ or }0] \quad (3)$$

In this equation, the axial friction force term related to tension will be zero if the element is in the straight section 76. Also, if the pipe element is in vertical section 72 both terms related to friction will be vanished.

Figure 3B:
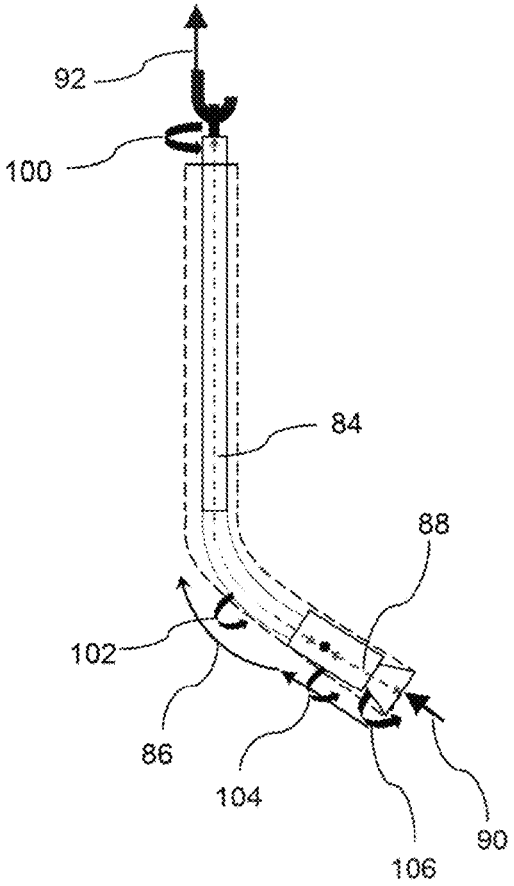

In FIG. 3*b* some weight of drillstring applies on drilling bit which means reduction in tension 84 along drillstring. The reduction in tension 84 has considerable effect on axial friction force 86 in the build-up section 74 but not straight inclined section 76. If applying the weight on the bit causes drillstring to be in compression 88 in the curved section 74, the axial friction force 86 for that part will not be another function of the tension 84. The equation (4) represents the force balance when applying weight on the bit 90.

$$F_{top}=(F_{bottom})_{DWOB}+\beta\times\mathrm{SW}-\mathrm{Friction}_{weight}-[(\mathrm{Friction}_{tension})_{DWOB}\text{ or }0] \quad (4)$$

In equation (4), the friction force 86 in the curved section 80 is affected by downhole weight on the bit 90 which is subscripted by DWOB. It should be mentioned the axial friction force 86 changes in the curved section will change the overall friction and surface hookload 92 value consequently.

The same story will happen for surface torque 94 measurements. The rotational friction forces 96&98 between drillstring and wellbore depend on normal weight of drillstring element and tension along drillstring. Applying weight on the bit 90 reduces the tension 84 along drillstring which affects the value of rotational friction force in the curved section 98. Equation (5) shows the torque for an element in drillstring while bit is off bottom and there is no weight on the bit 90.

$$\mathrm{Torque}_{top}=\mathrm{Torque}_{bottom}+\mathrm{Torque}_{weight}+[\mathrm{Torque}_{tension}\text{ or }0] \quad (5)$$

To calculate the surface torque 94, drillstring is divided to many numbers of elements and calculation starts from drilling bit to the surface. Once the element is in straight inclined section the torque will be the function of element weight only. When the element is in curved section 74 and the drillstring is in tension 84, the torque will depend on mostly tension 82 and less on weight. For surface torque 100 when drillstring goes on bottom, the tension 84 along drillstring will change which affects the value of rotational friction force 102 in the curved section 74 as well. Also, the value of torque on the bit 106 will be added as shown in equation (6). The rotational friction force 104 in the straight inclined section 76 will not change.

$$\mathrm{Torque}_{top}=\mathrm{Torque}_{bottom}+\mathrm{Torque}_{bit}+\mathrm{Torque}_{weight}+[(\mathrm{Torque}_{tension})_{DWOB}\text{ or }0] \quad (6)$$

Figure 4A:
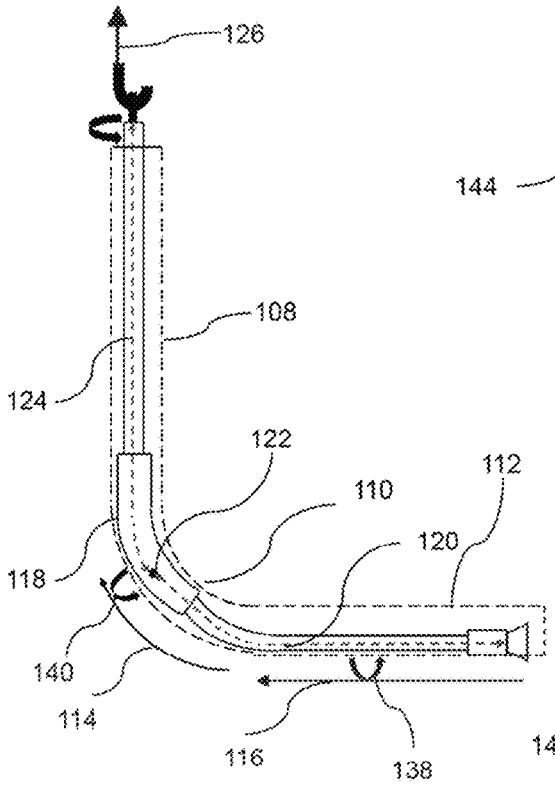

FIG. 4*a* shows a horizontal well which includes vertical 108, build-up 110 and horizontal 112 sections. The drillstring is off bottom and pushing toward the bottom. The axial friction force 114 is acting against the drillstring movement tendency. To push the pipe in the horizontal section 112, it is necessary to have some heavy drillpipes 118 in vertical 108 and build-up 110 sections for providing sufficient drive to push drillstring in the horizontal 112 section. The axial friction force 116 in horizontal section 112 is function of the weight of drillstring which normally applied on wellbore contact area. When drilling bit is off bottom and drillstring is pushing toward the bottom, some part of heavy drillpipe 118 will be in compression 120 due to axial friction force 116 in the horizontal 112 section. In this scenario, the axial friction force 114 in the curved section which is in compression 120 is only function of weight of drillstring element. Above neutral point 122, the drillstring will be in tension 124 and axial friction force 114 will be depends on the normal force and tension force for each element. If the element is in horizontal 112 section, the axial friction force 116 will depend only to weight of the element. The equation (3) can be applied for the horizontal well drilling for hookload calculation 126 when drilling bit is off bottom and moving toward the bottom. The friction force may be estimated according to a friction model using surface measurements conducted while the bit is off bottom.

Figure 4B:
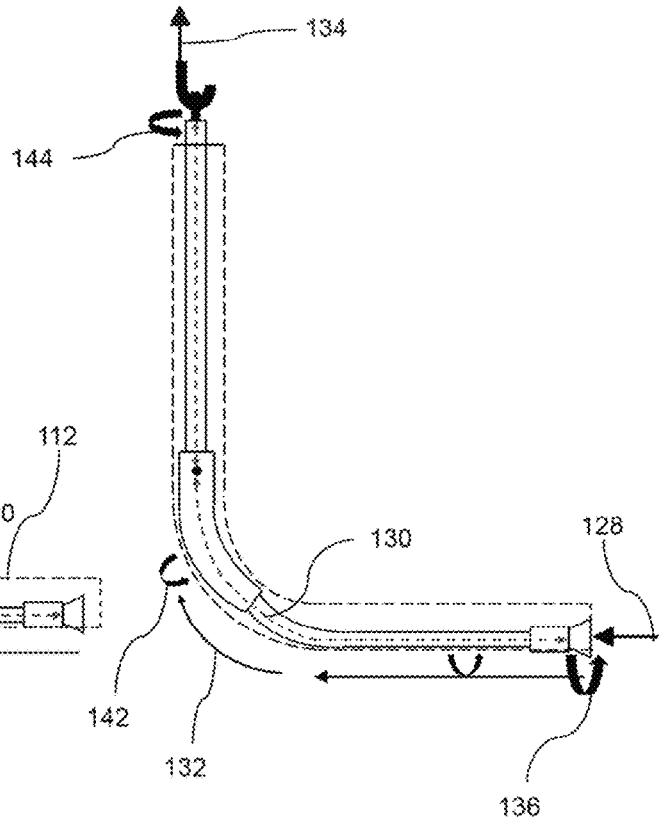

When some weight applies on the bit 128 as shown in FIG. 4*b*, the bigger length of drillstring goes in compression 130. In this case, usually the most of axial friction force 132 in the build-up section 110 will no longer depend on the tension. The equation (4) can be applied for hook load 134 calculations when drilling bit is on bottom: the hook load may be measured when the bit is off bottom and incorporated into the calculation of friction force.

In FIG. 4*a* once drillstring is off bottom, there is not bit torque 136. The rotational friction force is related to build-up 110 and horizontal 112 sections. In horizontal section 112 the rotational friction force 138 is the function of normal force which is applied by the weight of drillstring element. In build-up 110 section while drillstring element is in compression 120, the rotational friction force 140 is only the function of weight but if drillstring is in tension 124 the rotational friction force 140 is the function tension and weight. That is, different equations are employed to determine the downhole weight on bit depending on whether a part of the drillstring in a curved section is in compression or tension. Once drilling bit goes on bottom for drilling, applying weight on drilling bit 128 causes some reduction in tension 124 along drillstring which affects the value of rotational friction force 142 in the build-up 110 section. During drilling operation, there are some variations in bit torque 136 and rotational friction force 142 in the curved 110 section which should be estimated from surface torque measurements 144 by using present invention method.

Figure 5:
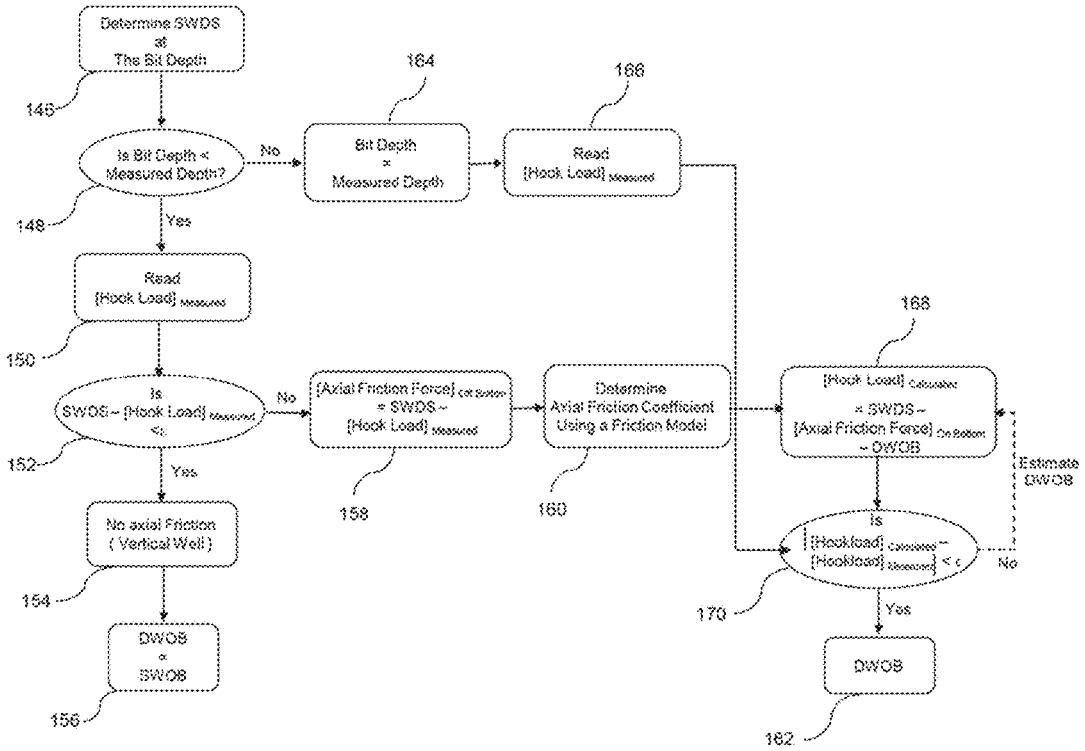
FIG. 5 is a flowchart showing exemplary steps for calculation of downhole weight on the bit by using hookload measurements.

FIG. 5 is a general flowchart showing the steps how "drilling system" can estimate downhole weight on the bit from surface measurements. The first step is determining the static weight of drillstring, SWDS 146. To calculate the SWDS 146 the following information are required at any measured depth:

survey point data, inclination drillstring components unit weights drilling fluid density to calculate the buoyancy factor.

There are standard equations which are used to calculate the static weight of drillstring 146. When the bit is off and then on bottom, a short length (the maximum is the length of a stand) will be added to drillstring and the positions of other components will be changed as well. For this reasons, it is required to update the SWDS 146 when drilling bit goes on bottom for further drilling. Also, in under balanced drilling, the drilling fluid density is variable; therefore the local buoyancy factor should be calculated for each element and is not constant anymore.

The second step is determining when the bit is off or on bottom 148. During drilling operations, the mud logging unit records all necessary field data. The measured depth and bit depth data will be used to know when the bit is off and on bottom 148 and also bit is moving upward or downward. Here, the measured depth corresponds to final drilled depth at any time of calculations. When the bit is off bottom and drillstring is moving downwardly, the measured hookload 150 should be compared with SWDS. If difference between values 152 is negligible, it means there is no axial friction force and the well geometry is vertical 154. When the bit goes on bottom, some weight of drillstring applies on the bit and a reduction in the hookload will be observed. The reduction in the hookload is taken as downhole weight on the bit, DWOB 156. Therefore the DWOB can be calculated directly from surface hookload measurements for a vertical well when drilling bit is off and on bottom.

If difference between measured hookload and SWDS is not negligible, the difference between these two values gives the axial friction force 158 between drillstring and the wellbore. It is very critical to select the best measured hookload value while the bit is off bottom because the axial friction coefficient 160 is estimated based on it. The estimated axial friction coefficient 160 will be used for estimating the DWOB 162 when the well is deviated and there is considerable axial friction force between drillstring and the wellbore. Hence, the hook load is measured when the bit is off bottom and used in the estimation of the axial coefficient including the drillstring rotation effect. Further, the surface measured hookload may be determined while the bit is off bottom and has a drillstring rotation and when the bit is sufficiently close to the bottom that the drillstring rotation is the same as the expected drillstring rotation in the formation to be drilled. Therefore the followings conditions are considered to select the best measured hookload value while the bit is off bottom:

The hookload is chosen when the bit is moving downwardly very close to bottom hole. In this situation the drillstring movement is very slow like on bottom situation while drilling bit is penetrating a formation.

The drillstring rotation speed is the same as planned one while the bit goes on bottom for further penetration. The effect of pipe rotation is included in axial friction coefficient By knowing the axial friction force and having a reliable friction model, the axial friction coefficient 160 which includes the drillstring rotation effect will be estimated. This axial friction coefficient 160 will be used for DWOB 162 calculation when the bit goes on bottom for further drilling.

The next step is when the bit depth and the measured depth 164 are equal which means the bit is on bottom. In this situation, the measured hookload 166 is known, as it is measured from the surface, and the hookload 168 could be calculated as well. To calculate the hookload 168, the SWDS 146, axial friction force and DWOB should be known. As discussed, the SWDS 146 is obtained directly from aforementioned standard equations. The DWOB 162 is estimated and the axial friction force will be calculated based on estimated DWOB. Here, to obtain the best value for DWOB 162, some value should be estimated close to surface weight on the bit and applies in friction model to see its effect on value of axial friction force. If the difference between measured and calculated hookload is negligible 170 then the value is taken as DWOB 162. Otherwise another value is chosen and repeat the calculation. This loop will be continued until the difference between calculated and measured values becomes negligible.

The estimate of downhole weight on bit and bit torque can be used to modify drilling or fracturing process. This may comprise taking an action to change drilling or fracturing of the formation based on the estimate of DWOB or bit torque. The modification of the drilling parameter during drilling is carried out by the drilling system system 44 and thus modifies the drilling process according to the modification of the drilling parameter. The estimated DWOB may be used to determine rate of penetration. Further, a better prediction of rock strength may be obtained based on inverted rate of penetration models. The predicted rock strength may be used to select a part of the formation to be fractured, and fracturing the selected part of the formation. In another embodiment, the autodrilling system described here may automatically adjust surface weight on bit. In a further embodiment, the drilling system displays surface WOB from hook load measurements and estimated downhole weight on bit. In an additional embodiment, when estimated weight on bit is non-zero and the rate of penetration is not increasing, the auto-driller may identify a founder-point.

The drilling system may learn from surface measured data during drilling by calibrating both axial and rotational friction coefficients from the surface measurement. The axial and rotational friction coefficients may be used to identify a drilling problem. The friction coefficients may additionally help identification of drilling problems such as string sticking or insufficient hole cleaning, and may be used in avoiding pipe sticking. In another embodiment, the action taken by the drilling system may be determining when to pull the bit off the bottom and then pulling the bit off the bottom.

The instructions for carrying out the processes described here may be contained in non-transient form on computer readable media. When saved to a computer forming part of the drilling system system, the instructions configure the drilling system system to carry out the instructions. The drilling system may comprise a rig, a drill string connected downwardly into a borehole, an drilling system, the drilling system being configured to carry out instructions of the processes described herein.

Figure 6:
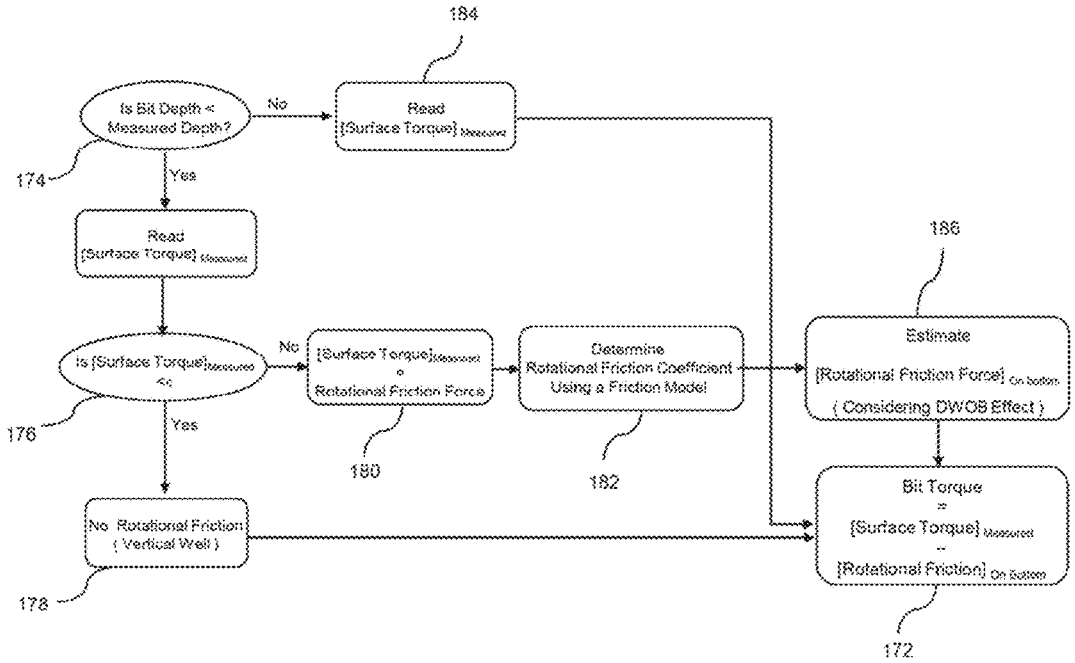
FIG. 6 is a flowchart showing exemplary steps for calculation of downhole bit torque by using the surface torque measurements.

FIG. 6 is a general flowchart showing the steps how "Drilling system" can estimate bit torque 172 when rotating from the surface. The procedure is mostly similar to downhole weight on the bit 162. That is, in a preferred embodiment, the process is similar to calculating downhole weight on a bit: determine the rotational friction force while the drilling bit is off bottom; determine the rotational friction coefficient including axial pipe movement effect from surface torque measurements while bit is off bottom; determining the effect of downhole weight on the bit on value of rotational friction force during drilling; and determining downhole bit torque by using rotational friction coefficient and estimated downhole weight. An estimate of rotational friction force while the bit is on bottom is estimated by using the rotational friction coefficient and downhole weight on the bit. The estimated rotational friction force will be deducted from measured surface torque to find the downhole bit torque. The changes in downhole weight on the bit will change the rotational friction force which affects the value of the bit torque. In one embodiment, the rotational friction coefficient including the drillstring axial movement effect may be estimated while the bit is off bottom and there is no torque at the bit. Note that different equations may be used when determining downhole torque on bit depending on whether a part of the drillstring in a curved section is in compression or tension.

The estimated downhole weight on the bit 162 in previous section is used for downhole bit torque calculation 172. In the first step, the bit depth should be compared with measured depth 174 to see the drilling bit is on bottom or off bottom. When drilling bit is off bottom and the value of the measured surface torque is negligible 176, it means the drilling well is vertical and there is negligible rotational friction force 178. When drilling bit goes on bottom for further drilling, the measured surface torque almost corresponds to downhole bit torque 172. If the measured surface torque is not negligible while bit is off bottom, it means the well is not vertical and there is rotational friction force against drillstring rotation 180. As discussed before, the best selected data is when the bit is off bottom and is moving downwardly close to the bottom with the same pipe rotation as planned for drilling. From the rotational friction force 180 while bit is off bottom and using a reliable friction model, the rotational friction coefficient 182 could be estimated for next steps.

When the bit goes on bottom for further drilling, the measured surface torque 184 can be read. The downhole weight on drilling bit, DWOB 162, will affect value of rotation friction force 186 due to changes in tension along drillstring. Using DWOB 162 and rotational friction coefficient 182 in a reliable friction model yields the rotational friction force during drilling operation which changes whit the changes in DWOB 186. The final step is calculating the downhole bit torque due to surface rotation by subtracting the rotational friction force from surface torque measurements 172.

Example Application

A friction model is applied to estimate DWOB and bit torque during drilling operations. When drillstring specification, survey data and friction coefficient are specified, the calculation begins at the bottom of drillstring and continues stepwise upwardly. Each drillstring element contributes small load on hookload and surface torque. The force and torque balance on drillstring element when the bit is off bottom can be written as follows:

$$F_{top} = \beta w \Delta L\left(\cos\alpha \text{ or} \frac{\sin\alpha_{top} - \sin\alpha_{bottom}}{\alpha_{top} - \alpha_{bottom}}\right) - \mu \times \beta w \Delta L\left(\sin\alpha \text{ or} \frac{-\cos\alpha_{top} + \cos\alpha_{bottom}}{\alpha_{top} - \alpha_{bottom}}\right) + (F_{bottom} \text{ or } F_{bottom} \times e^{-\mu|\theta|}) \quad (7)$$

However the following might be used when the drillstring is in compression in the curved section $$F_{top} = \beta w \Delta L \cos\left(\frac{\alpha_{top} + \alpha_{bottom}}{2}\right) + \mu\left[\left(F_{bottm}(\phi_{top} - \phi_{bottom})\sin\left(\frac{\alpha_{top} + \alpha_{bottom}}{2}\right)\right)^2 + \left(F_{bottom}(\alpha_{top} - \alpha_{bottom}) + \beta w \Delta L \sin\left(\frac{\alpha_{top} + \alpha_{bottom}}{2}\right)\right)^2\right]^{0.5} + F_{bottom} \quad (8)$$

For the torque at each element:

$$T_{top} = T_{bottom} + \mu \times r \times \beta w \Delta L \times \left(\sin\alpha \text{ or } \frac{-\cos\alpha_{top} + \cos\alpha_{bottom}}{\alpha_{top} - \alpha_{bottom}}\right) + (0 \text{ or } \mu \times r \times F_{bottom} \times |\theta|) \quad (9)$$

Corresponding to equation (8) the torque can be expressed as the following:

$$T_{top} = \mu \times r \times \left[\left(F_{bottom} \times (\phi_{top} - \phi_{bottom}) \times \sin\left(\frac{\alpha_{top} + \alpha_{bottom}}{2}\right)\right)^2 + \left(F_{botom} \times (\alpha_{top} - \alpha_{bottom}) + \beta \times w \times \Delta L \times \sin\left(\frac{\alpha_{top} + \alpha_{bottom}}{2}\right)\right)^2\right]^{0.5} + T_{bottom} \quad (10)$$

Where w: Unit weight of drillstring element

ΔL: Length of the drillstring element

α: Inclination

μ: Friction coefficient

θ: Dogleg angle r: Tool joint radius

In the equations (7), the terms in order for an element correspond to static weight, the axial friction force caused by the weight and axial friction force caused by the tension at the bottom. In the equations, if the inclination at the top and bottom of an element is equal, the element is considered as straight and the first term in each bracket will be used otherwise it will be considered as a curved element and second term will be used. Equation (8) is for compressed drillstring in the curved section Also for bit torque calculation, equations (9) (10) are used.

Figure 7:
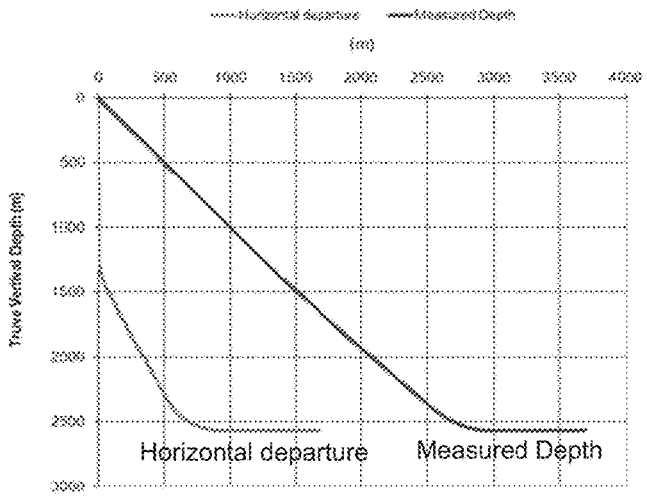
FIG. 7 shows geometry of a drilled well which includes vertical, build-up, straight inclined and horizontal sections. The horizontal departure and measured depth have been plotted versus true vertical depth.
Figure 8:
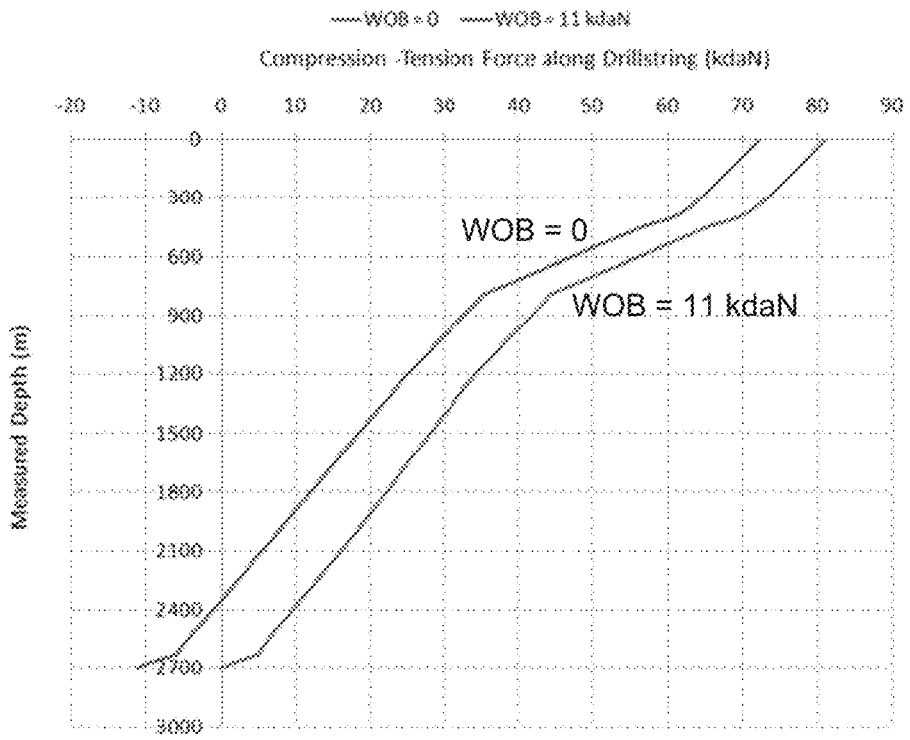
FIG. 8 compares tension and compression along drillstring when 11 kdaN weight applies on the bit.
Figure 9:
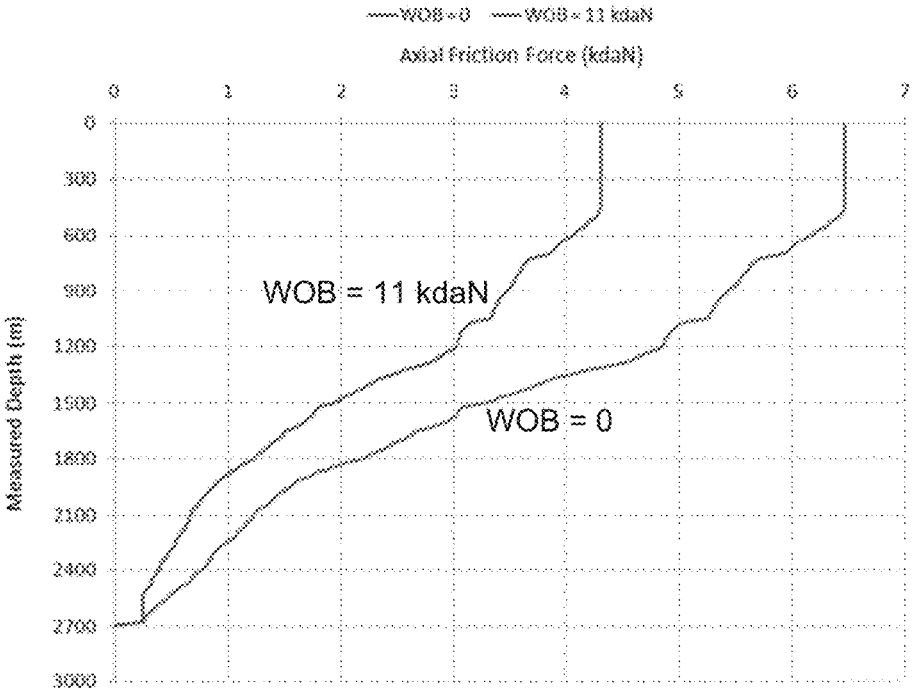
FIG. 9 shows reduction in axial friction force along drillstring when 11 kdaN weight applies on the bit.

A drilled well was selected as shown in FIG. 7 to illustrate how drilling system can estimate the downhole weight on the bit and bit torque. The well geometry includes two build-up sections, straight and horizontal sections. When drill bit is at depth 2700 m, the entire drillstring was at tension. Applying 11 kdaN weight on the bit causes some portion of drillstring starting from bit to go in compression and reduce the tensile force for the rest as shown in FIG. 8. This reduction in tension along drillstring has effect on value of friction force as shown in FIG. 9 as much as 2.15 kdaN. In the example, the downhole weight on the bit has effects only on the friction forces in those build-up sections. As discussed before, the weight on the bit will reduce the friction force in the curved sections which affect axial and rotational friction force as well. The sample calculation has been shown as follow:

When the bit is at depth 2695.6 m, almost 0.4 m off bottom and moving downwardly, the axial friction coefficient including pipe rotation effect is estimated as follow:

Static Weight of Drill String=874.4 kN

Bit Depth=2694.6 m

Measured Depth=2696.02 m

Bit Depth≤Measured Depth→$[\text{Hook Load}_{Off}]_{Measured}$=810.2 kN $$[\text{Axial Friction Force}]_{Off\ bottom} = 874.4 - 810.2 = 64.4\ \text{kN} \xrightarrow{\text{Using Friction Model}} \mu_{axial} = 0.095\ \text{(pipe rotation included)}$$

The axial friction coefficient including the pipe rotation effect will be used when drillstring goes on bottom for drilling. The axial friction coefficient can be updated for each wiper trip periodically and used for upcoming sections. The estimated axial friction coefficient is used in a friction model to calculate the hookload.

Bit Depth=2696.02 m

Measured Depth=2696.02 m

Bit Depth=Measured Depth→$[\text{Hook Load}_{On}]_{Measured}$=760 kN

SWOB=94 kN

The different values for downhole weight on the bit should be estimated until the difference between the measured and calculated hookloads become negligible. When the difference is acceptable, the final estimated value for downhole weight on the bit will be chosen.

| DWOB, kN | $[\text{Hookload}]_{Calculated}$, kN | $[\text{Hookload}]_{Calculated} - [\text{Hookload}]_{Measured} \leq 1.00$ kN |
|---|---|---|
| SWOB = 94 | 739.5 | 20.50 |
| 90 | 742.9 | 17.10 |
| 85 | 746.9 | 13.10 |
| 80 | 751 | 9.00 |
| 75 | 745 | 5.00 |
| DWOB = 70 | 759 | 1.00 |

Figure 10:
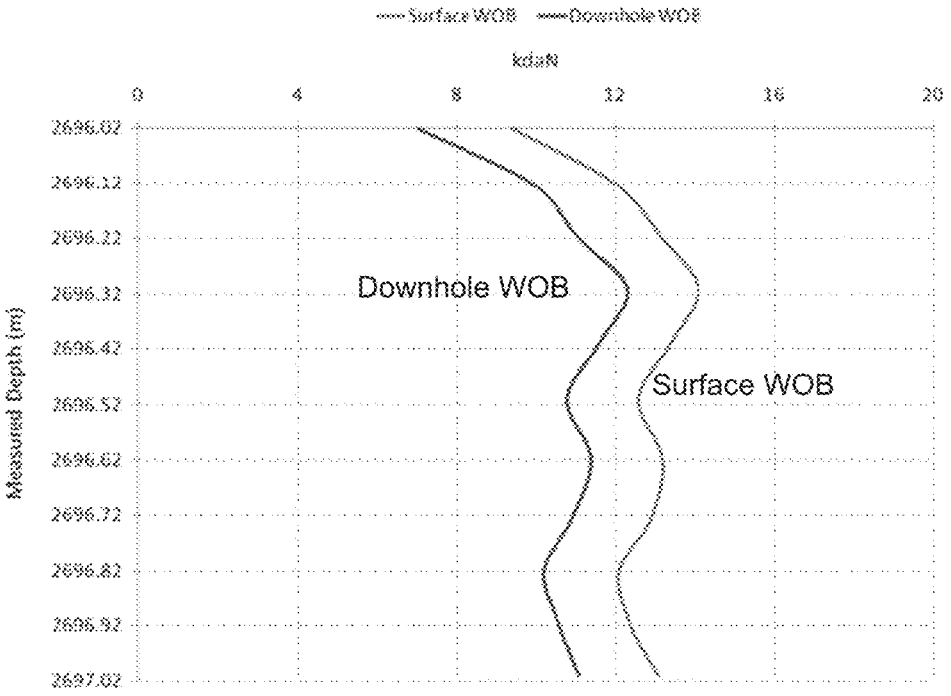
FIG. 10 shows the surface and downhole weight on the bit for 1 m drilled interval. The downhole weight on the bit is calculated as disclosed.

The FIG. 10 compares surface and downhole weight on the bit values for one meter drilled interval using the present invention method.

For surface torque measurement, the increment in surface torque when drilling bit goes on bottom for drilling consider as bit torque. The reduction in tension has a considerable impact on value of rotational friction force which should be counted for bit torque calculations.

In this field example, when the bit is off bottom and moving downwardly with the same RPM as planned for drilling, the measured surface torque is as follow:

Bit Depth=2695.6 m

Measured Depth=2696.09 m

Bit Depth≤Measured Depth→$[\text{Surface Torque}]_{Measured}$=13.5 kN·m

The Measured surface torque is equal to rotational friction force. By using a reliable friction model, the rotational friction coefficient can be estimated:

$$[\text{Rotational Friction Force}]_{off\ bottom} = 13.5\ \text{kN.m} \xrightarrow{\text{Using Friction Model}} \mu_{Rotational} = 0.245$$

When drilling bit is on bottom and some weight applies on drilling bit, the surface torques measurement increase due to interaction between drilling bit and rock surface. The difference between surface torque measurements for off and on bottom drilling positions consider as surface bit torque as shown as follow:

$[\text{Surface Torque}_{on\ bottom}]_{Measured}$=14.86 kN·m→Surface Bit Torque=14.86−13.5=1.36 kN·m But when some weight applies on the bit, the tension along drillstring will be reduced and rotational friction force will be reduced as well which should be consider for bit torque measurements.

$$[\text{RotationalFrictionForce}]_{on\ bottom} \xrightarrow{\text{DWOB} = 120\ \text{kN}} 12.34\ \text{kN}$$

The downhole torque at the bit can be estimated as follow:

$$\begin{aligned}\text{Downhole Bit Torque} &= [\text{Surface Torque}_{on\ bottom}]_{Measured} - [\text{Rotational Friction Force}]_{on\ bottom} \\ &= 14.86 - 12.34 \\ &= 2.52\ \text{kN}\cdot\text{m}\end{aligned}$$

The estimate of bit torque can be used to modify a drilling parameter. The drilling parameter can be, for example, surface torque, drillstring rotation rate or hookload.

Figure 11:
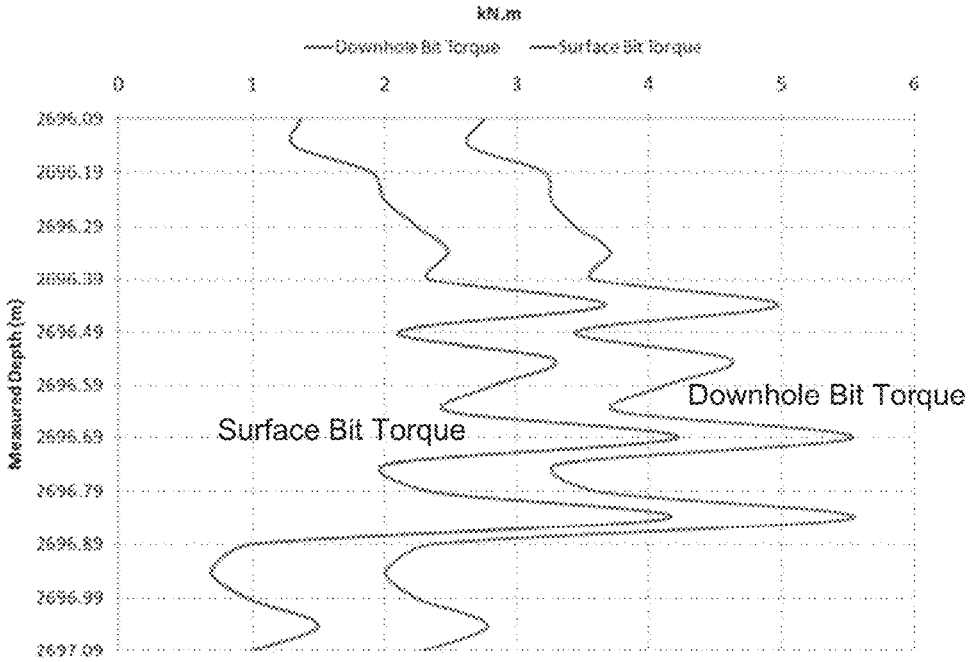
FIG. 11 shows the surface and downhole bit torque for 1 m drilled interval. The downhole torque at the bit is calculated as disclosed.

FIG. 11 compares the surface and downhole bit torque for one meter interval by considering effect of downhole weight on the bit on rotational friction force.

Figure 12:
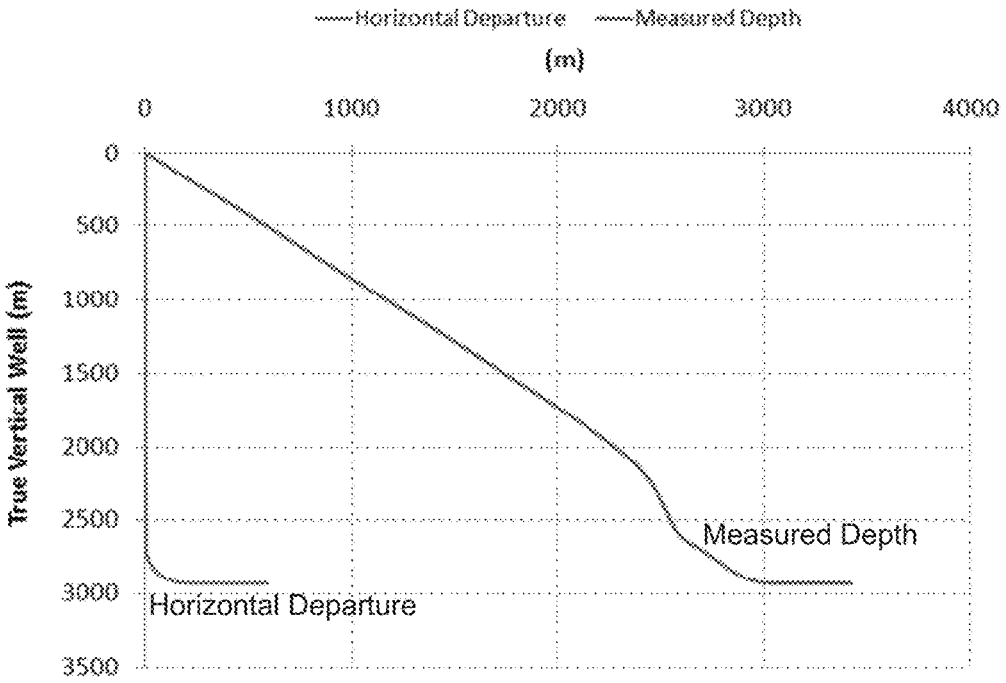
FIG. 12 shows geometry of a short bend horizontal well which include vertical, build-up and horizontal sections. The horizontal departure and measured depth have been plotted versus true vertical depth.
Figure 13:
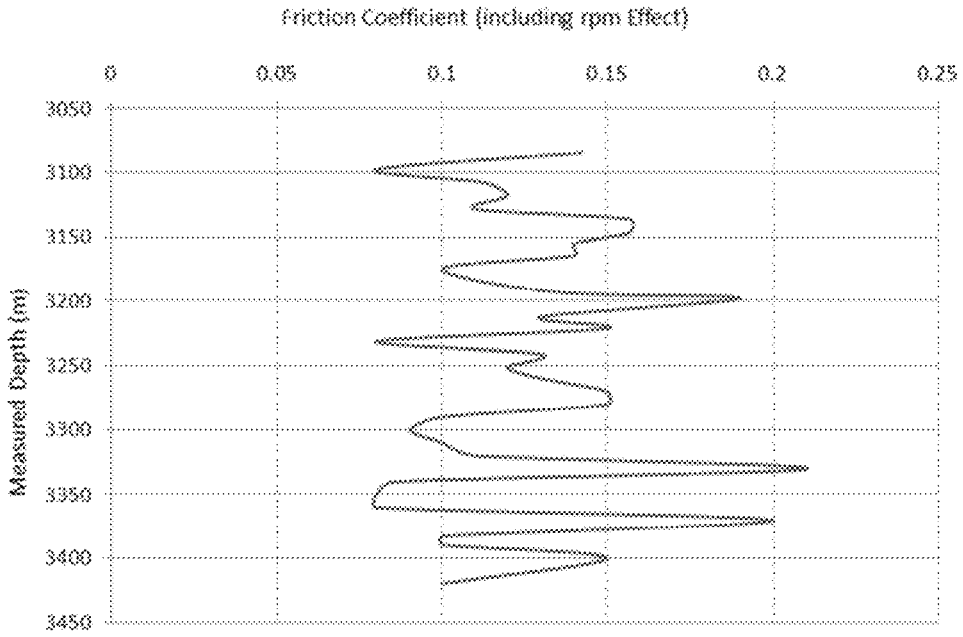
FIG. 13 illustrates friction coefficient versus measured depth during drilling operation for the interval between 3070 m to 3420 m. The estimated friction coefficients include effect of drillstring rotation.
Figure 14:
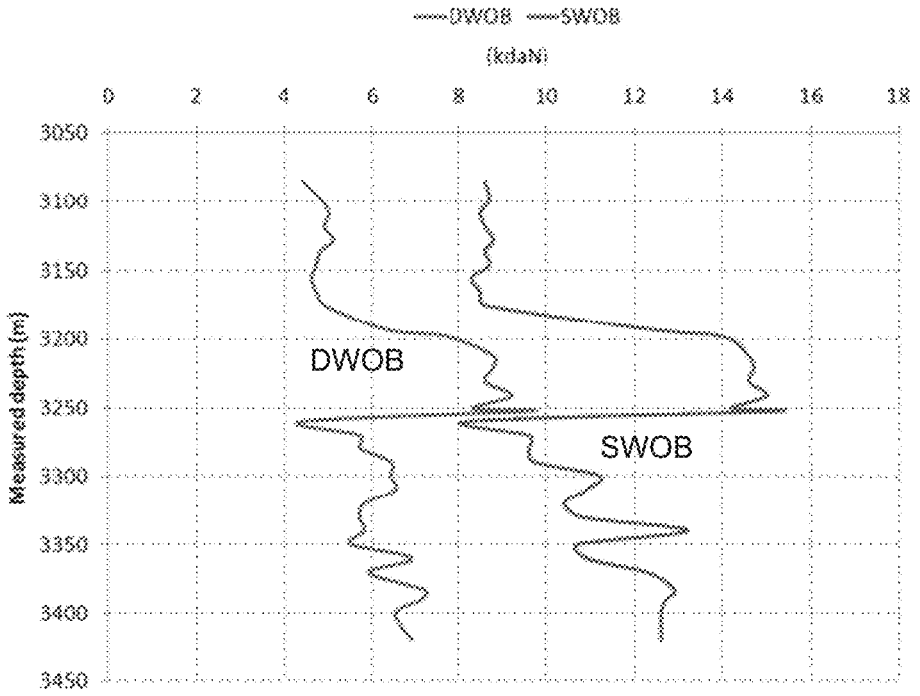
FIG. 14 compares the surface and downhole WOBs for the drilled interval from 3070 m to 3420 m.
Figure 15:
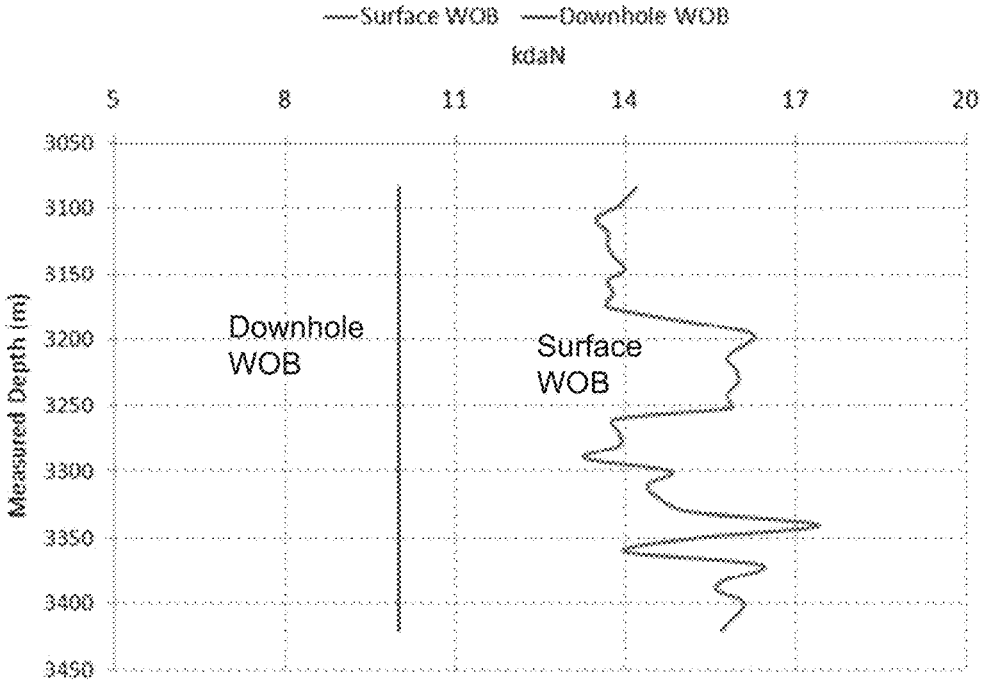
FIG. 15 shows surface WOB values versus measured depth during drilling operation when keeping 10 kdaN downhole weight on the bit.

FIG. 12 is well geometry of another example which verifies the application of the current method. 350 m drilled interval has been selected to estimate downhole weight on the bit from hookload measurements. As discussed previously, the friction coefficient should be estimated and updated during drilling operation. FIG. 13 illustrates the plot of friction coefficient including drillstring rotation effect versus measured depth for this 350 m drilled interval to use for downhole weight on the bit estimation. FIG. 14 compares the surface and downhole weight on the bit which estimated by using drilling system. To apply a constant weight on the bit as much as 10 kdaN, the drilling system estimate the value of surface weight on the bit versus measured depth as shown in FIG. 15.

Figure 16:
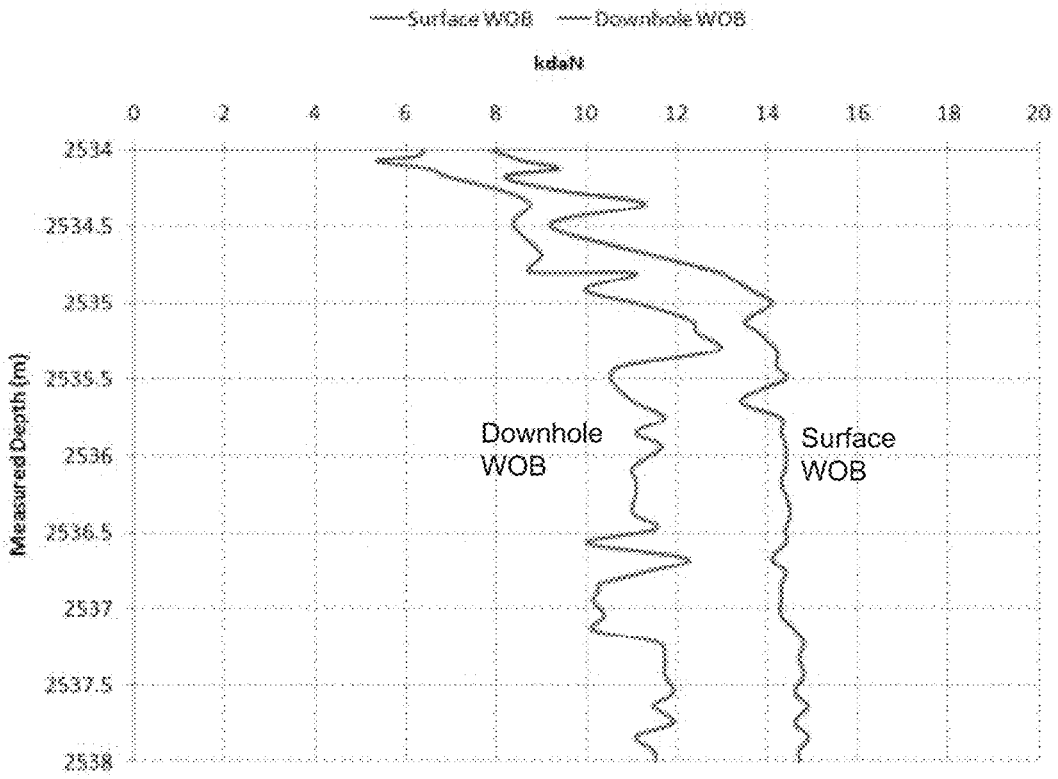
FIG. 16 compares surface and downhole WOBs for a drilled interval from 2534 m to 2538 m. The downhole WOB was estimated using "K" value multiplication into differential pressure across downhole motor.

Also, this drilling system can be used for sliding drilling which is used for directional or horizontal drilling. This drilling system may be used in sliding drilling using a mud driven motor, where the drilling bit rotated by mud motor instead of rotating the drillstring from surface. The mud motor is powered by the fluid differential pressure. There is a certain relationship between differential pressure and DWOB which can be found by using present system. Here "K" value is used to represent the ratio of DWOB to differential pressure which can be found during rotating time. When sliding begins, a new DWOB can be predicted with the product of K and differential pressure. As an example, the average value for "K" is estimated during rotating time as much as $$0.67\frac{\text{kN}}{\text{kPa}}$$

for a drilled interval. The differential pressure was multiplied by "K" value to estimate DWOB as shown in FIG. 16. The drilling system may use K to improve drilling performance.

In all of example application, a newly developed analytical model was used to calculate the axial and rotational frictions between drillstring and the wellbore. This model can be replaced by any other analytical and numerical models to calculate axial and rotational friction forces for downhole weight on the bit and bit torque estimation.

For example, using finite element method, an attempt has been made to calculate friction forces between wellbore and drillstring. In this modeling, the drillstring can be thought of as a very long rotor of variable geometry constrained within a continuous journal bearing of variable clearance and rigidity. The equations of motion are based on Hamilton's principle $$[M]\{\ddot{U}\}+[C]\{\dot{U}\}+[K]\{U\}=\{F\} \tag{11}$$

Where the vectors $\{U\}$, $\{\dot{U}\}$, $\{\ddot{U}\}$ and $\{F\}$ represent generalized displacements, velocities, accelerations and forces, respectively. Also the matrixes M, C and K represent mass, damping and stiffness respectively. The forces include gravity, unbalanced mass and frictions with the wellbore. Wilson-θ, a kind of numerical method, is used to get the solution to the above equation. Based on the equation, numerical solution method and appropriate boundaries, a finite element analysis (FEA) program is developed to do the calculation and analysis of torque and drag under different drilling modes with vertical, directional and horizontal wells.

The Combined Use of TTS with the Drilling System to Get Better Results.

The surface weight on bit (SWOB) is obtained usually by the difference between the hookload when the drill bit is very close to but off the bottom and the hookload when drilling is on afterwards. But those hookloads are not accurate because of friction from the sheaves. Some dedicated surface measuring tools, such as torque and tension (TTS) sub from Pason Systems Corp., can be used to measure the more accurate hookloads. Installed in the top drive assembly below the quill, the Pason TTS far exceeds the accuracy and responsiveness of other sensors used in the industry today. It uses temperature compensated strain gauge technology to measure the forces being applied to it, eliminating the need for field calibration. The hookload measured with TTS is called net hookload, which is used to calculate the downhole weight on bit (DWOB) with the model disclosed in this patent. In the model, a sheave efficiency coefficient is used to calculate the net hookload from surface hookload (usually measured on the deadline). The coefficient is uncertain and different with different rigs, so there could be a problem when using the model, which means there exist big errors because the coefficient is very sensitive. However with the TTS, the coefficient can be obtained or adjusted. There are two ways to solve the problem. One is to use TTS obtain the coefficient in the initial stages of drilling, then TTS can be removed in the following drilling. The other is to use TTS in the whole process of drilling. Anyway the TTS is an important measuring tools and the model will get more accurate DWOB if the TTS is integrated with the drilling system. This is because the use of TTS removes the uncertainty of the sheaves and the hook. As for non-top drive rigs, another TTS will be designed and integred into the drilling system disclosed in the patent. In conclusion the drilling system in this patent can be put into better use in conjunction with a measuring tool like the TTS or similar system.

In this project ROP models were developed for some common IADC tricone bit types and PDC bits. The ROP models developed integrate the effect of drill bit operating parameters like WOB and RPM, drilling bit hydraulics including nozzle sizes, flowrate, mud weight, mud plastic viscosity through hydraulic horsepower and bit design and wear parameters depending on the bit type. The ROP models are further verified and matched to laboratory drilling data collected at a full scale research drilling rig.

The two set of ROP equations developed for tricone and PDC bits are different in that the cutting action, bit wear and hydraulics effect of each bit type is different. The developments of the different ROP models are therefore discussed separately.

Figure 17:
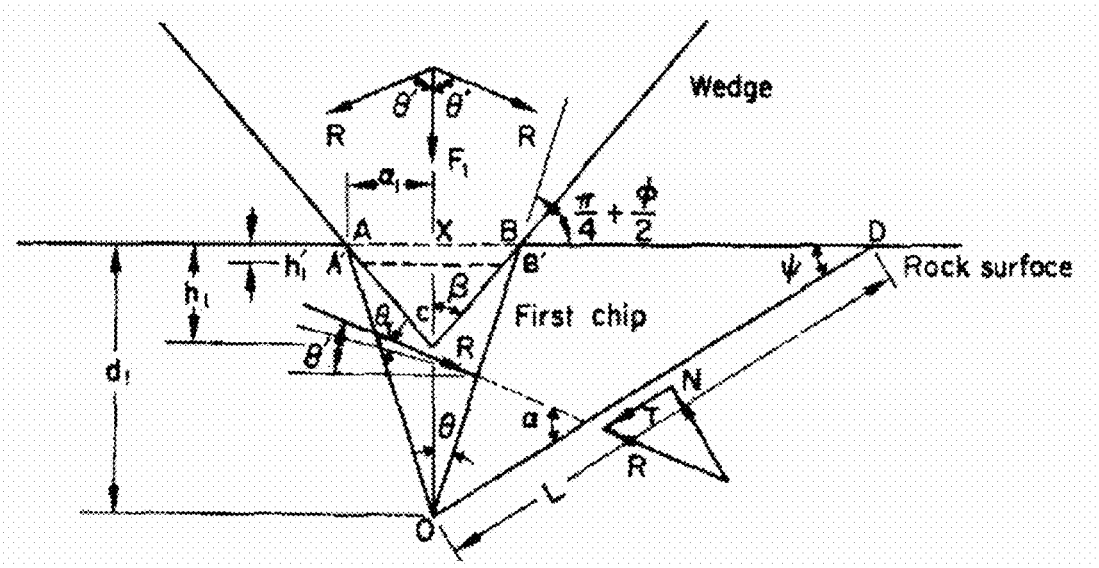
FIG. 17 is an illustration of the wedge angle of a single cutter.

FIG. 17 is a diagram showing a model of chipping of a rock caused by a drill bit penetrating into a rock surface, taken from Dutta 1972 "A theory of percussive drill bit penetration". In this diagram, a wedge-shaped bit ACB is shown with penetration $h_1$. If the bit is truncated as represented by blunt wedge AA'B'B, according to the model the same wedge of crushed rock is formed with bit penetration $h_1'$. In this figure $h_1$ represents the depth of initial penetration when the chipping starts, ψ represents the angle of fracture plane OD to the rock surface BD, ϕ represents the angle of internal friction of the rock, θ represents the half-wedge angle of the crushed rock mass AOBC, β represents the half-wedge angle of the bit ACB, N represents the normal force to the fracture plane OD, T represents the shear force on the fracture plane OD, and R represents the total force exerted by the rock wedge on the solid rock.

The Tricone ROP Model

The tricone model developed in this project is based on the single cutter rock bit interaction analytically assuming a perfect cleaning model initially. Perfect cleaning means all the cutting debris is immediately removed by the drilling fluid under the bit and no regrinding of cutting or bit balling is taking place. The model for each bit IADC code design is then empirically modified to match the laboratory drilling data and to integrate the hydraulics for bits with no wear. The bit wear effect on ROP is integrated next using the wear function into the ROP model which was taken from the work by Wu (Wu, 2010).

The perfect cleaning tricone model is developed from the equations developed using the single cutter-rock interaction modeling from Evans (1962), Paul (1965), Dutta (1971) later modified by Hareland (2010) and Rashidi (2011) as;

$$ROP_{clean} = K\frac{WOB^a * RPM^b}{CCS^c * D_b^2 * (\tan\theta)^d} \tag{12}$$

Where a, b, c, and d are emperical constants determined from laboratory data, WOB is the weight on bit, RPM is the bit rotational speed, CCS is the confined rock strength, $D_b$ is the bit diameter and θ is the half wedge angle as illustrated by the single cutter action in FIG. 17.

For a given IADC code bit type (θ is constant) the model and integrating the bit wear function, $W_f$, as modeled by Wu (2010) the ROP equation becomes;

$$ROP_{clean} = K\frac{WOB^a * RPM^b}{CCS^c * D_b^2 * (\tan\theta)^d} \cdot W_f \tag{13}$$

Figure 18:
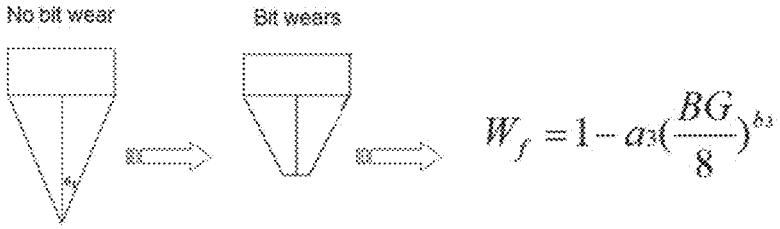
FIG. 18 is an illustration of wear of a tricone cutter.
Figure 19:
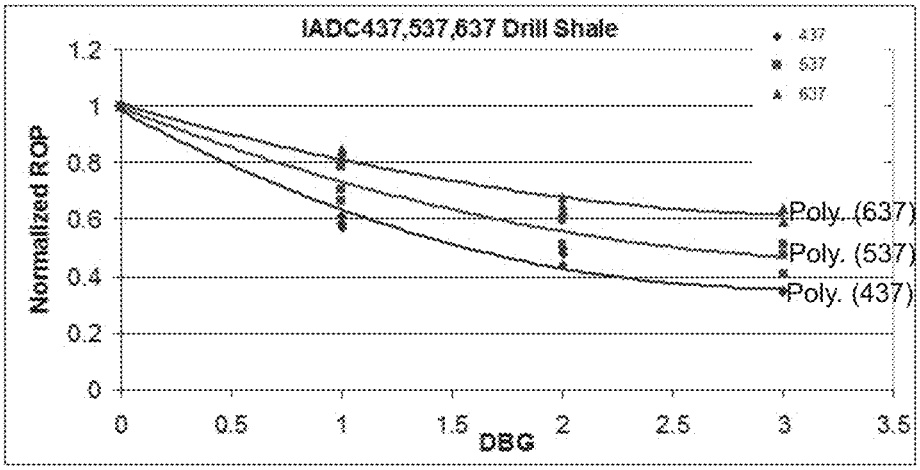
FIG. 19 is a graph showing the reduction of rate of penetration with respect to bit wear for several IADC codes.

The wear function is for a given IADC bit type modeled as;

$$W_f = 1 - a_3\left(\frac{\Delta BG}{8}\right)^{b_3} \tag{14}$$

Where ΔBG is the IADC bit grade and $a_3$ and $b_3$ are constants for a give IADC bit type as defined by Wu (2010). Bit wear is illustrated in FIG. 18 showing a wedge-shaped bit become truncated by wear. FIG. 19 is a graph showing normalized rate of penetration for bits with different IADC codes. Equation 15 shows how the total change in bit grade over time can be calculated as the sum of rates of change of bit grade at points in time. At points in time after the drilling is started, the bit grade can be estimated based on this change in the bit grade.

$$\Delta BG = C_a \cdot \sum_{n}^{i=2} WOB_i \cdot RPM_i^{0.6} \cdot CCS_i \cdot Abr \tag{15}$$

The effect of bit hydraulics is defined in the h(x) function as an efficiency between 0 and 100 percent where 100 percent is perfect cleaning.

The model integrates hydraulics through the hydraulic function h(x):

$$ROP_{actual}=ROP_{clean}\cdot h(x)$$

$$ROP_{actual}=K_1\cdot HSI^{K_2} \tag{16}$$

The suggested h(x) form of the hydraulics model is $$h(x) = a_2\left(\frac{HSI}{ROP_{clean}}\right)^{b_2} \tag{17}$$

Figure 20:
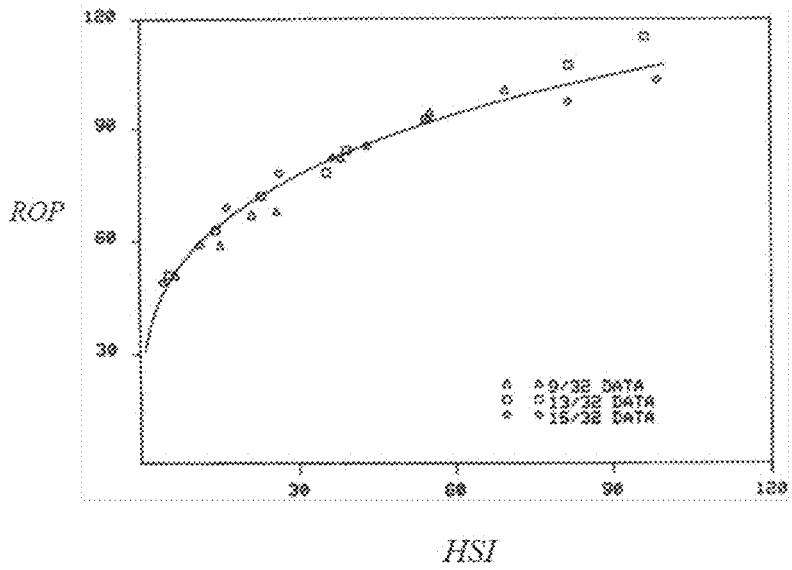
FIG. 20 is a graph showing the rate of penetration with respect to hydraulic level.
Figure 21:
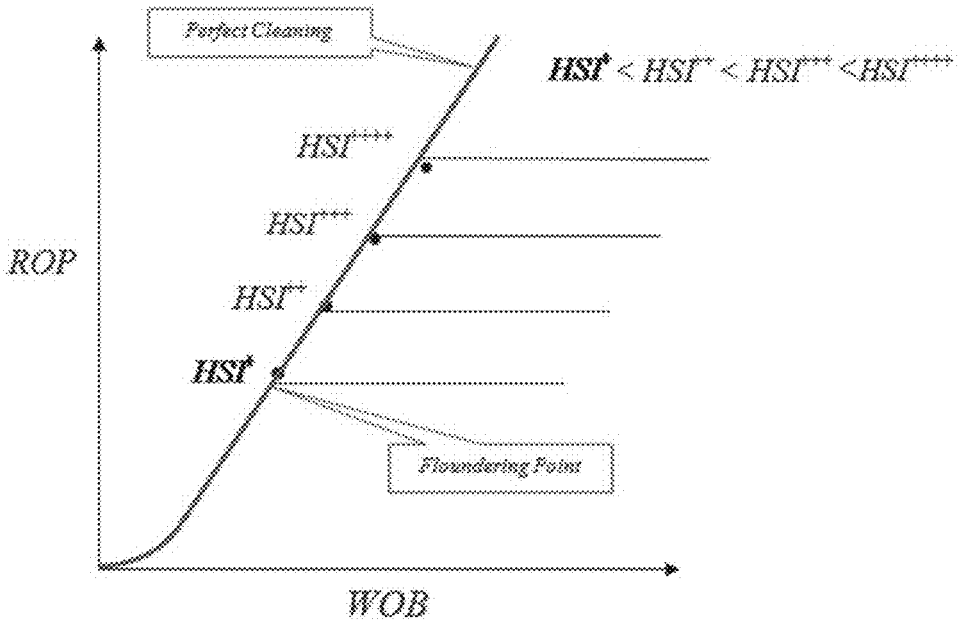
FIG. 21 is a schematic graph showing how the graph of rate of penetration v. weight on bit changes for different hydraulic levels.
Figure 22:
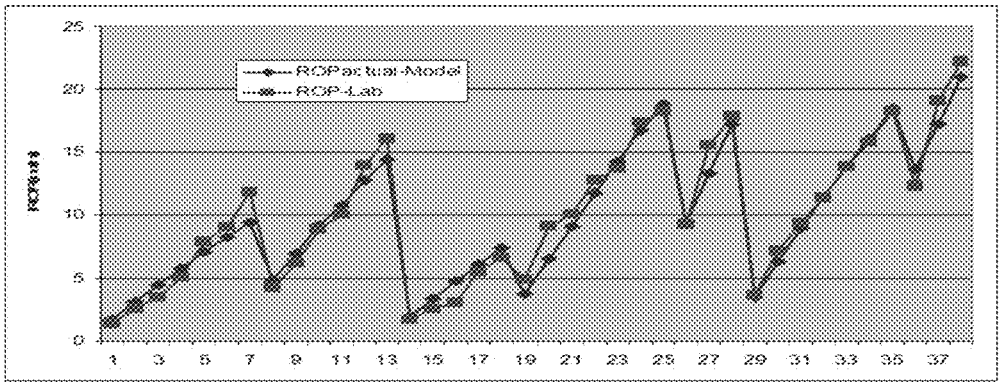
FIG. 22 is a graph showing a comparison of the ROP values obtained from the model with that from laboratory experiment for IADC 117.
Figure 23:
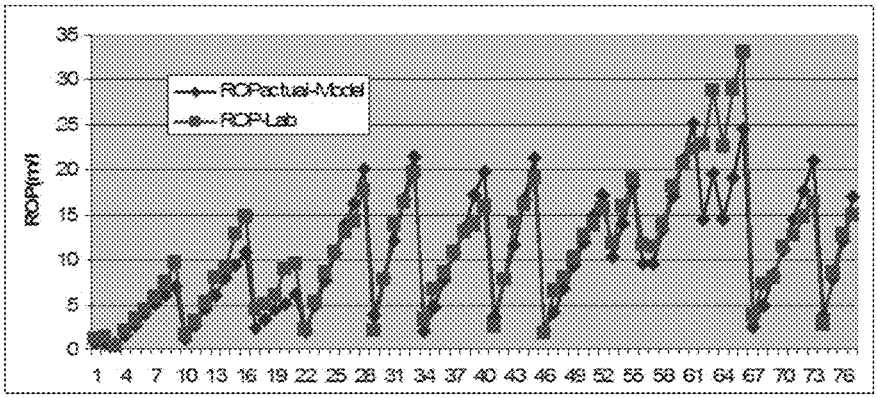
FIG. 23 is a graph showing a comparison of the ROP values obtained from the model with that from laboratory experiment for IADC 437.
Figure 24:
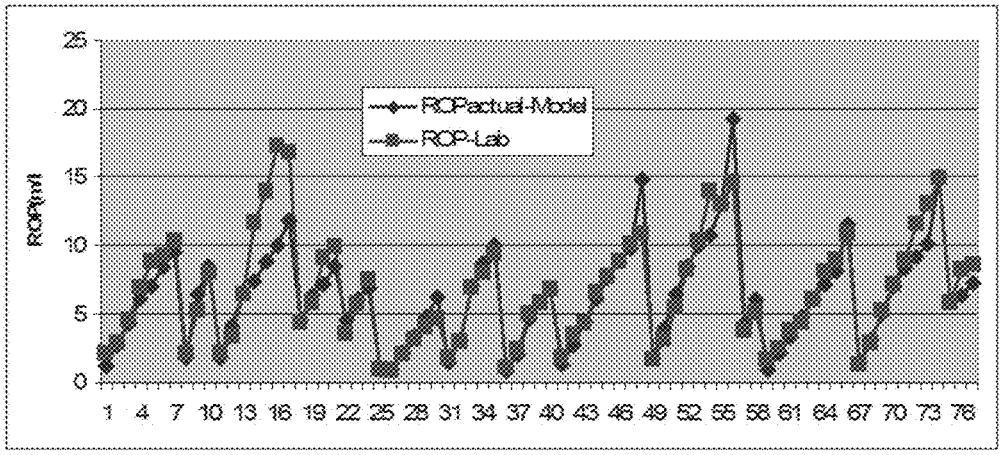
FIG. 24 is a graph showing a comparison of the ROP values obtained from the model with that from laboratory experiment for IADC 517.
Figure 25:
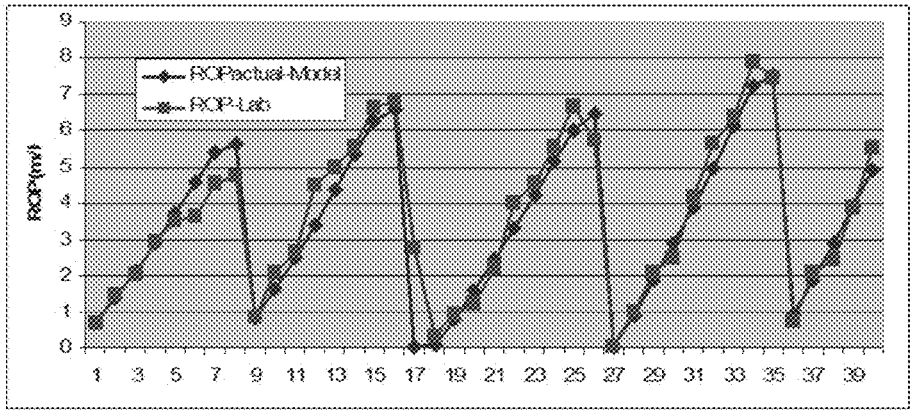
FIG. 25 is a graph showing a comparison of the ROP values obtained from the model with that from laboratory experiment for IADC 627.

FIG. 20 is a graph of rate of penetration with respect to hydraulic level. FIG. 21 is a schematic diagram showing how rate of penetration varies with respect to weight on bit with different hydraulic levels. The figure is only schematic, in actuality the ROP curves away from the perfect cleaning line smoothly at each HSI level rather than abruptly as shown. The relationship of rate of penetration and weight on bit was modeled as well as determined experimentally for IADC 117, IADC 437, IADC 517 and IADC 627 bits in limestone and shale at different rates of bit rotation. FIG. 22 is a graph showing a comparison of the ROP values obtained from the model with that from laboratory experiment for IADC 117; the horizontal axis represents the datapoint number. FIG. 23 is a graph showing a comparison of the ROP values obtained from the model with that from laboratory experiment for IADC 437; the horizontal axis represents the datapoint number FIG. 24 is a graph showing a comparison of the ROP values obtained from the model with that from laboratory experiment for IADC 517; the horizontal axis represents the datapoint number. FIG. 25 is a graph showing a comparison of the ROP values obtained from the model with that from laboratory experiment for IADC 627; the horizontal axis represents the datapoint number.

The Tricone Rock Strength Equation

By rearranging the ROP equation and solving for confined rock strength, CCS the equation becomes;

$$CCS = \left[\frac{ROP_{lab}}{K \cdot WOB^{b1} \cdot RPM^{c1} \cdot H(x) \cdot W_f}\right]^{\frac{1}{a1}} \tag{18}$$

$$H(x) = a2 \cdot \frac{(HSI)^{b2}}{ROP_{lab}^{c2}} \tag{19}$$

$$W_f = 1 - a_3 \cdot \left(\frac{\Delta BG}{8}\right)^{b_3} \tag{20}$$

Make sure h(x) less than 1.0, which means h(x) is assigned 1.0 if greater than 1.0. Incremental BG is defined as for the PDC and was first introduced by (Hareland, 1993) and (Rampersad, 1996)

Figure 26:
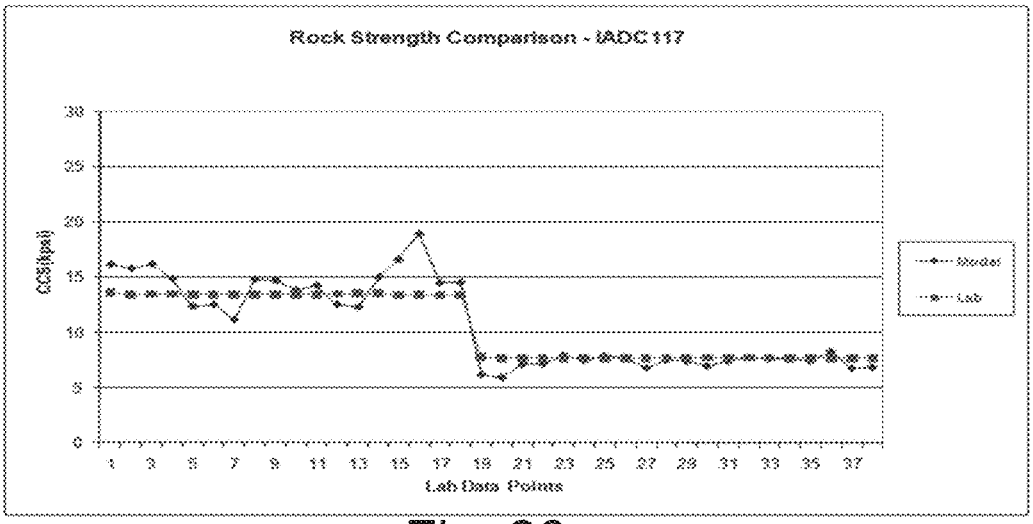
FIG. 26 is a graph showing a comparison or rock strength between the predicted values and the lab data for roller cone bit IADC 117.

FIG. 26 is a graph showing a comparison of rock strength (CCS) between the predicted and the lab data for roller cone bit IADC 117.

Figure 29:
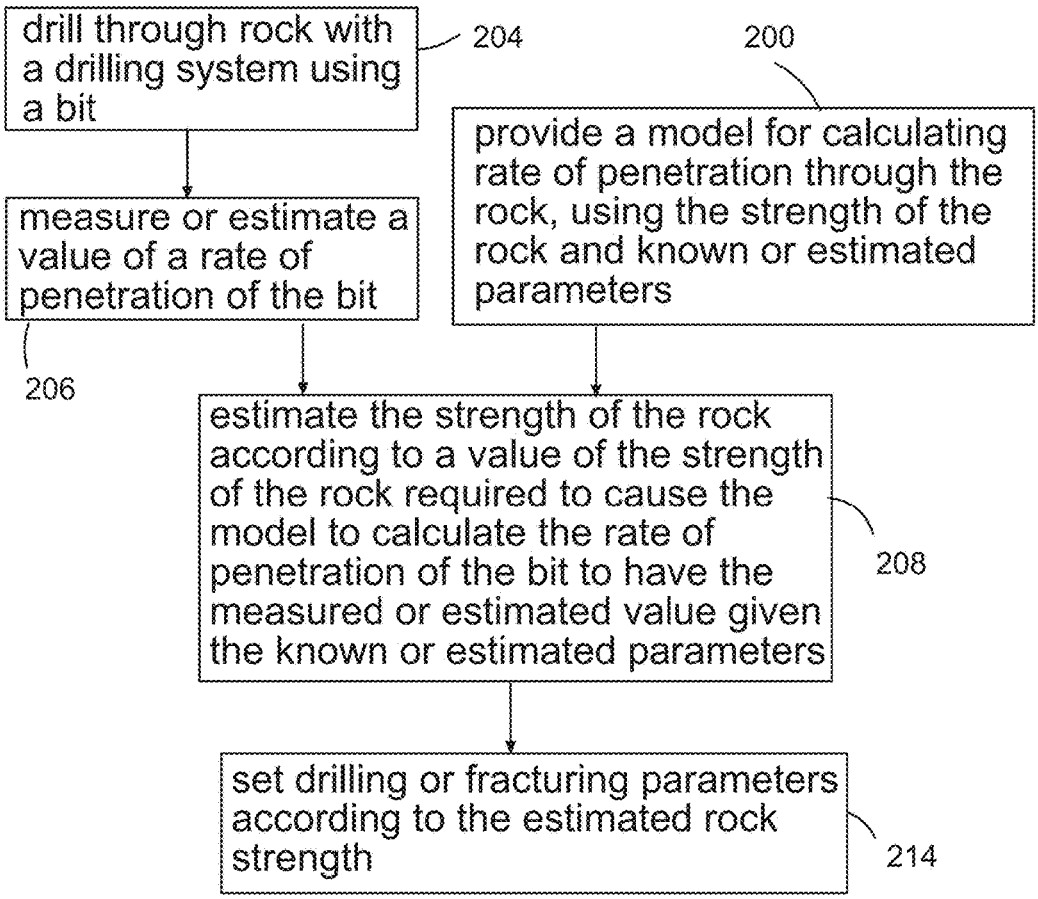
FIG. 29 is a flow diagram showing a method of using a rate of penetration model to estimate rock strength and set drilling or fracturing parameters according to the estimated rock strength.
Figure 30:
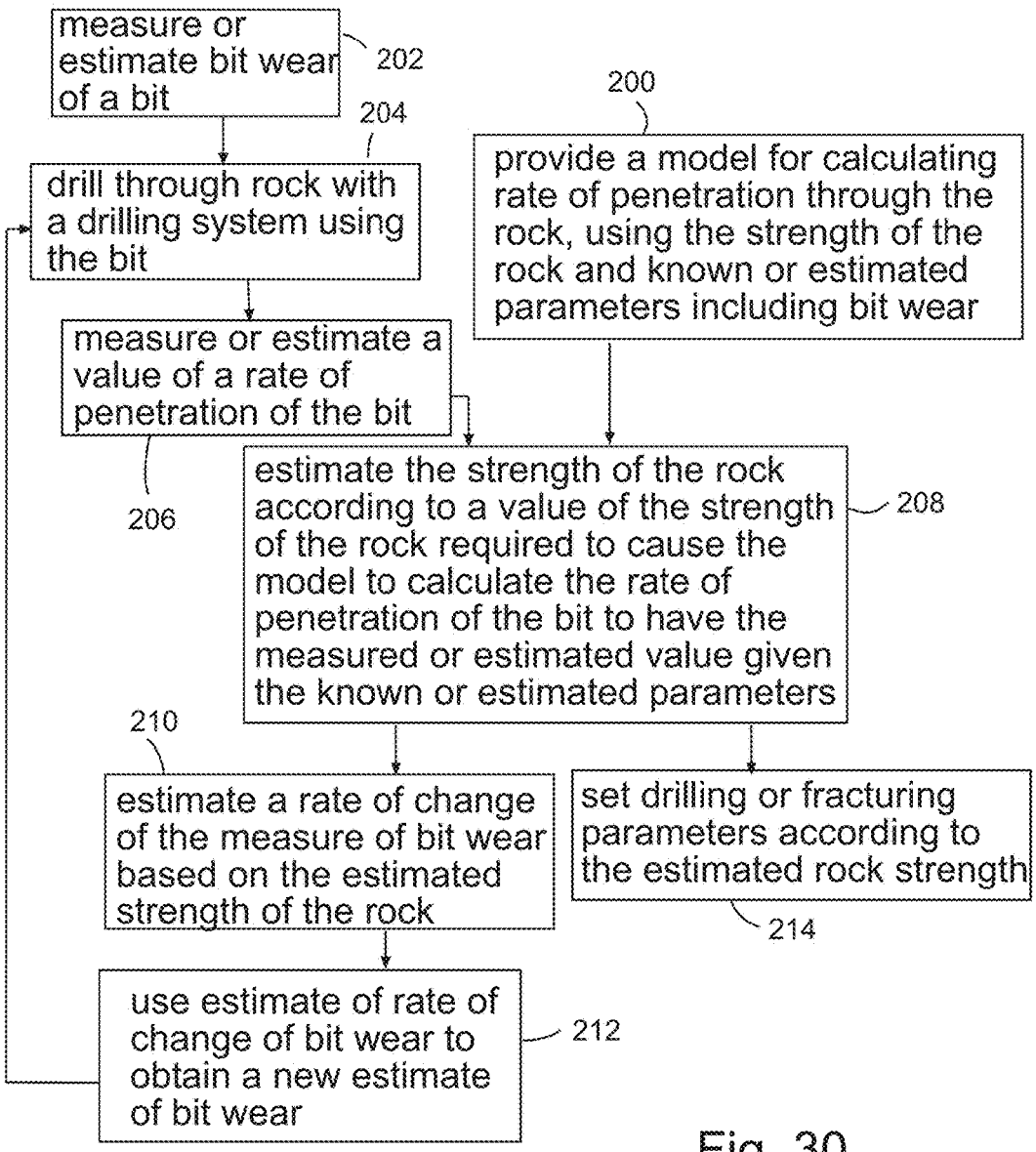
FIG. 30 is a flow diagram showing a method of using a rate of penetration model to estimate rock strength and set drilling or fracturing parameters according to the estimated rock strength, in which a rate of change of a measure of bit wear is calculated, and the measure of bit wear at a subsequent point in time is estimated using the rate of change of bit wear.

FIG. 29 and FIG. 30 are flow diagrams showing methods of using a rate of penetration model to estimate rock strength and set drilling or fracturing parameters according to the estimated rock strength. Referring to FIG. 29, in step 200 a model is provided for calculating rate of penetration through rock is provided, using the strength of the rock and known or estimated parameters. In step 204 rock is drilled through with a drilling system using a bit. In step 206, a value or estimate of a rate of penetration of the bit is measured or estimated. In step 208 the strength of the rock is estimated according to a value of the strength of the rock required to cause the model to calculate the rate of penetration of the bit to have the measured or estimated value given the known or estimated parameters. In step 214 drilling or fracturing parameters are set according to the estimated rock strength. Referring to FIG. 30, in step 200 a model is provided for calculating rate of penetration through rock is provided, using the strength of the rock and known or estimated parameters including bit wear. In step 202, the bit wear is measured or estimated (for example, if a bit is new, it might be estimated as having no wear). In step 204 rock is drilled through with a drilling system using a bit. In step 206, a value or estimate of a rate of penetration of the bit is measured or estimated. In step 208 the strength of the rock is estimated according to a value of the strength of the rock required to cause the model to calculate the rate of penetration of the bit to have the measured or estimated value given the known or estimated parameters. In step 210, a rate of change of the measure of bit wear is estimated based on the strength of the rock. In step 212, at a subsequent point in time steps 204-210 are repeated using the estimate of rate of change of bit wear to obtain a new estimate of bit wear. In step 214, drilling or fracturing parameters are set according to the estimated rock strength.

The rock strength profile is iteratively determining the confined rock strength CCS and for each depth increment this value may be converted into the ARSL or UCS value which is a function of the rock confinement being either positive or negative depending on if the rock was drilled over or underbalanced. $P_e$ is the confining pressure seen at the bit and it is the difference between the hydrostatic mud pressure minus the formation pore pressure at the drillbit when drilling.

The CCS is the confined UCS and may be correlated to a rock material property through the normalization of the confining pressure (overbalance) effect as;

$$CCS=UCS\times(1.0+a_s\times P_e^{b_s}) \tag{26}$$

Or $$UCS=CCS/(1.0+a_s\times P_e^{b_s}) \tag{27}$$

The $CCS_{ubd}$ is what the bit sees when drilling underbalanced and the UCS is the UCS at an equivalent confining pressure of zero value for Pe (Shirkavand, 2009). This is then the reference UCS at zero confinement and is a rock material property. a' is a specifically calibrated rock property for that specific rock type.

$$CCS_{ubd} = \left(\frac{2}{3}\right) \times UCS \times \exp(-a' \times P_e) + \left(\frac{1}{3}\right) UCS$$

There are four possible stress models (Barree):

Uniaxial strain model in which there is deformation in one direction and horizontal stress required to assure no lateral strain:

$$\sigma_h = \frac{v}{1-v}(\sigma_v - P_p) + P_p$$

The model assumes the following: the rock is tectonically relaxed and the stresses are only due to the elastic response of the overburden, horizontal stress is transversely isotropic, Poisson's ratio is isotropic in all directions, Simple poroelastic relationship are applicable, Viscoelastic (creep) and thermal effects can be ignored.

Tectonic stress model using constant regional offset $\sigma_{tect}$ is input constant:

$$\sigma_h = \frac{v}{1-v}(\sigma_v - P_p) + P_p + \sigma_{tect}$$

Tectonic strain model: stresses generated by regional strains:

$$\sigma_x = \varepsilon_x E_x \text{ and } \sigma_y = \varepsilon_y E_y$$

$$\sigma_h = \frac{v}{1-v}(\sigma_v - P_p) + P_p + \varepsilon_x E_x$$

Plane strain model: couples horizontal stresses for no vertical displacement, relates tectonic effects to both E and v, requires knowledge of both horizontal stresses, is the default model used in most log analysis packages $$\sigma_h = \frac{v}{1-v}(\sigma_v - P_p) + P_p + \frac{E}{1-v^2}(\varepsilon_x + v\varepsilon_y)$$

Uniaxial strain and plane strain models were used for the purposes of this study.

Poisson's ratio can be determined from $$v = \frac{R-2}{2R-2}$$

where $R=\Delta t_s^2/\Delta t_c^2$, $\Delta t_s$ and $\Delta t_c$ are the shear and compressional travel times in microseconds per foot Young's modulus (E) can be calculated directly using $$E = 13447\rho_b \frac{3R-4}{\Delta t_c^2 R(R-1)}$$

If the shear travel time data is not available the following estimates of Poisson's ratio for different lithology can be used (Barree):

$$v_{quartz}=1\times10^{-7}\Delta t_c^3-6\times10^{-5}\Delta t_c^2+0.0107\Delta t_c-0.2962$$

$$v_{limestone}=-3\times10^{-7}\Delta t_c^3+0.0001\Delta t_c^2-0.0116\Delta t_c+0.6462$$

$$v_{dolomite}=-2\times10^{-6}\Delta t_c^2+0.0007\Delta t_c+0.228]$$

$$v_{coal}=3\times10^{-7}\Delta t_c^3-8\times10^{-5}\Delta t_c^2+0.0041\Delta t_c+0.4779$$

$$v_{clay}=9\times10^{-8}\Delta t_c^3-4\times10^{-5}\Delta t_c^2+0.0086\Delta t_c-0.1559$$

A similar correlation exists to estimate Young's Modulus from lithology and compressional travel time (Barree):

$$(E/\rho)_{quartz}=1\times10^{-7}\Delta t_c^4-5\times10^{-5}\Delta t_c^3+0.0094\Delta t_c^2-0.8073\Delta t_c+27.682$$

$$(E/\rho)_{clay}=1\times10^{-7}\Delta t_c^4-5\times10^{-5}\Delta t_c^3+0.0094\Delta t_c^2-0.8063\Delta t_c+27.296$$

$$(E/\rho)_{limestone}=4\times10^{-8}\Delta t_c^4-2\times10^{-5}\Delta t_c^3+0.004\Delta t_c^2-0.3801\Delta t_c+14.974$$

$$(E/\rho)_{dolomite}=8\times10^{-8}\Delta t_c^4-4\times10^{-5}\Delta t_c^3+0.0078\Delta t_c^2-0.6599\Delta t_c+22.588$$

$$(E/\rho)_{coal}=1\times10^{-6}\Delta t_c^3 0.0006\Delta t_c^2+0.069\Delta t_c-1.8374$$

where $\Delta t_c$ is in μsec/ft, E is in $10^6$ psi and ρ is in g/cm$^3$.

Maximum Horizontal Stress Magnitude

The maximum horizontal stress is the most difficult component of the stress tensor to determine. It can be estimated where breakouts or drilling induced fractures are observed on image logs and where compressive strength or tensile strength is known. The tangential stress is the stress concentration around the borehole that is responsible for borehole breakout and/or drilling induced fractures at the borehole wall. The tangential stress is given as $$\sigma_\theta=\sigma'_H+\sigma'_h-2(\sigma'_H-\sigma'_h)\cos 2\theta-(p_w-p_p)$$

where $\sigma'_H$ and $\sigma'_h$ are the effective horizontal stresses and θ is the angle measured clockwise around the borehole from $\sigma_H$ direction.

When SH magnitude is the only unknown its value can be varied until the stress concentration is such that either the compressive strength of the rock is consistent with the occurrence of breakout and/or is minimized such that it is less than the tensile strength consistent with the occurrence of drilling induced fracture. In this manner it is possible to constrain the SH at which failure will occur for a given stress state and rock strength.

Figure 27:
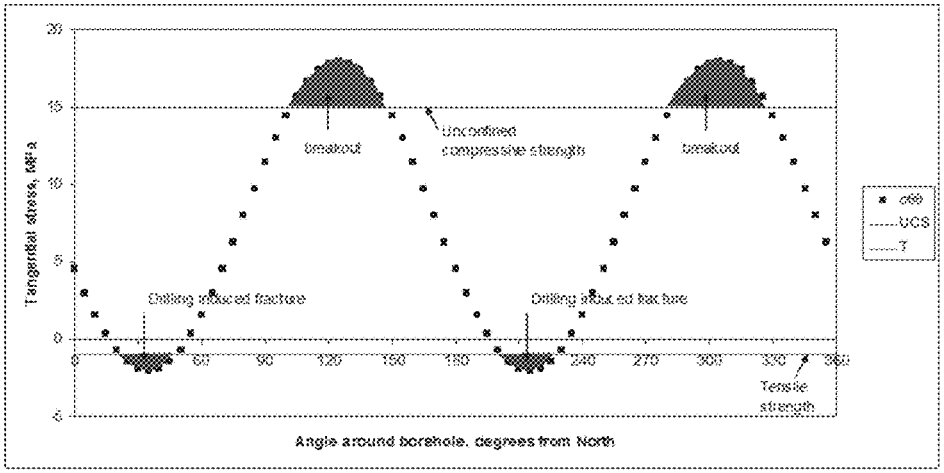
FIG. 27 is a diagram showing example magnitudes of tangential stress around a borehole, with example thresholds for breakout and drilling induced fracture.

FIG. 27 is a diagram showing example magnitudes of tangential stress around a borehole, with example thresholds for breakout and drilling induced fracture.

The most reliable maximum horizontal stress measurements have been derived from hydraulic fracturing (Hubbert & Willis, 1957; Haimson & Fairhurst, 1970). Most controlled hydraulic fractures in sedimentary basins result in least principal stress magnitudes lower than the corresponding overburden stress indicating that the minimum horizontal stress had been measured.

The breakdown pressure equations could be used in an inverse manner to infer the in-situ stresses from the pressure data collected during the fracture treatments. At least two breakdown pressure criteria exist for interpreting $p_b$ in terms of the far-field stresses. They are the following:

The Hubbert-Willis expression, which is applicable to impermeable rocks, is shown as $$p_b=3\sigma_h-\sigma_H+T-p_o$$

The Haimson-Fairhurst expression, which is applicable to permeable rocks, is shown as $$p_b = \frac{3\sigma_h - \sigma_H + T - 2\eta p_o}{2(1-\eta)}$$

In the above equations, $\sigma_H$ and $\sigma_h$ are maximum and minimum horizontal stresses, $p_o$ is the pore pressure, T is the tensile strength of rock, and $\eta$ is a poroelastic constant which varies in the range of [0, 0.5] and is defined as $$\eta = \frac{\alpha(1-2\nu)}{2(1-\nu)}$$

where $\alpha$ is Biot's constant and $\nu$ is Poisson's ratio. This parameter controls the magnitude of the stress induced by percolation of fluid in the rock. Both breakdown pressure equations are based on the assumption that breakdown takes place when the tangential effective stress at the borehole wall reaches the tensile of the rock. In the limit of $\eta=0$, the Haimson-Fairhurst criterion becomes $$p_b = \frac{1}{2}(3\sigma_h - \sigma_H + T)$$

There is a range of possible solutions for the hydraulic fracture initiation pressure with lower and upper bounds corresponding to the limit of slow and fast pressurization rates.

In the slow limit, pore pressure in the vicinity of the borehole wall is the same as the fluid pressure in the borehole $p_w$, while in the fast limit, the pore pressure remains at its initial value $p_o$. These two limits correspond to the Haimson-Fairhurst criterion (slow limit) and the Hubbert-Willis criterion (fast limit), provided that $p_o$ in the Hubbert-Willis criterion is interpreted as the initial fluid pressure in the borehole before the pressurization leading to breakdown, and not necessarily as the far-field pore pressure.

In absence of tensile strength experimental data, the tensile strength can be estimated using Murrel's extension of the Griffith criterion $$C_0=12T_0$$

which usually fits experimental results better than that of the Griffith criterion (Fjær et al, 1992).

C0 is the unconfined rock strength that can be estimated from Apparent Rock Strength Log (ARSL) or correlation from sonic log (Onyia, 1988):

$$C_0 = 2000 + \frac{1}{5.15\times10^{-8}(\Delta t_c - 23.87)^2}$$

or by Andrews et al (2007):

$$C_0 = \frac{217457}{(\Delta t_c - 40)^{0.52}}$$

where $C_0$ is the unconfined rock strength in psi and $\Delta t_c$ is compressional travel time in μsec/ft.

From fracture treatment charts for several formations breakdown pressure, closure pressure, and pore pressure magnitudes were obtained. Poisson's ratios are calculated from full waveform sonic log data or by using Barree's correlation for specific lithology if shear travel times are not available. Biot's constants were determined using the following equation:

$$\alpha = 1 - \frac{K}{K_s}$$

where K and $K_s$ are the bulk modulus of rock and the grain, respectively. The bulk modulus of the rock is calculated from $$K = \frac{E}{3(1-2\nu)}$$

The bulk modulus of quartz and clay are 76 and 42 GPa, respectively.

Figure 28:
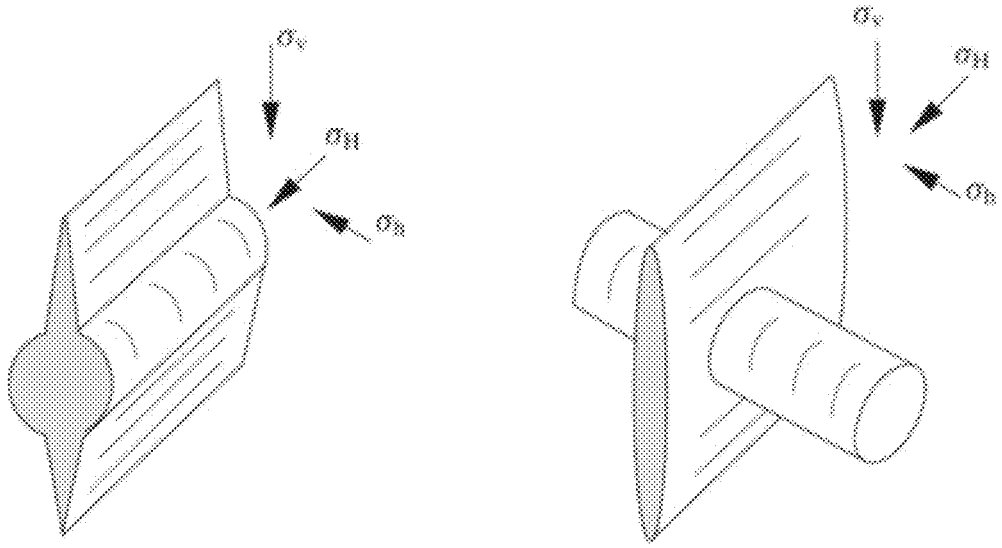
FIG. 28 is an illustration of different fracture directions, parallel to a horizontal borehole (left) and perpendicular to the horizontal borehole (right)

FIG. 28 shows possible fracture directions. On the left a fracture is shown parallel to a horizontal borehole and on the right a fracture is shown perpendicular to the horizontal borehole.

Effects of Stress State on Fracturing

Evaluation of the caliper logs from some wells indicated that there could be a normal in-situ stress state. The expected fracture scenario is therefore a standing fracture that extends in the horizontal direction. If a large volume is injected, long fractures are created. The fracture will also attempt to grow upwards. This represents a potential risk for unintentional leaks to surface. In the following we will therefore discuss the mechanisms that may arrest undesired upward fracture growth.

For deviated wells, the induced fractures will initiate along the borehole axis, but twist towards the in-situ stress state which controls fracture propagation outside the borehole region. The fracture propagates in a direction normal to the least in-situ stress but in the direction of the intermediate in-situ stress.

The oil industry assumes two opposite penny-shaped fractures. In the following several fracture related issues will be discussed.

Upward Fracture Growth

One critical issue is the question of whether the fracture will propagate to surface resulting in an uncontrolled release of fracture fluids and negative environmental impact. Valko and Economides (1995) define barriers to upward fracture growth as follows:

Stress barrier. If a higher stress state exists in a rock above the injection zone, upward growth may be arrested.

Elasticity barrier. If there is higher stiffness in the rock above, fracture propagation may be limited or stopped. This could be a caprock.

Permeability barrier. If the fracture propagates into a permeable rock, it may be arrested and not propagate further.

Rock consolidation, especially in deepwater unconsolidated sand reservoirs.

Valko and Economides (1995) provide a detailed review of the basic calculations of fracture growth. It is deterministic and supports the barriers defined above.

Although the fundamental mechanics is well developed, Valko questions the exactness of the models based on field observations. Perhaps the lack of, or poor input data into the models contributes to this concern. He also suggests that we should look for lamination contrast. A caprock above a reservoir could give this contrast.

In field applications it is often difficult to obtain all data for the analysis. Stresses are obtained from LOT data at specific depths and often in competent shales. The only way to assess shallower or deeper stress states is by using logs.

Shale Hydration vs Mechanical Stress

To add lubricity (thereby decreasing drill string torque and drag) and eliminate shale hydration and attendant wellbore failure due to same, wells can be drilled with an invert/oil based mud. Given that shale hydration has been eliminated as a potential cause of well bore breakout it must be assumed that residual breakout can be attributed to in-situ stress.

Development of Borehole Stability Guidelines

Some formations exhibit weaker layers than other.

Thickness and frequency of weaker formation layers/lenses are virtually impossible to predict but none-the-less pose an extremely significant risk with respect to caving in and sticking the drill string. At best, significant lost rig time would be required to recover the drill string (~0.25 MM$), at worst, the well would need to be abandoned (loss of ~4.5 MM$). A relationship between wellbore collapse, horizontal stress, ARSL and rock mechanical properties was therefore required. The following formulae developed by Fjer et al 2008 (assumes wellbore failure phenomenon occurs at the sandface and therefore is adequately described by a linear elasticity model) was used to calculate wellbore collapse pressure (Pw). Inputs and origin of inputs are listed:

$$Pw=[3(Sv-\mathrm{Pp})-(SH-\mathrm{Pp})-\mathrm{UCS}]/[(\tan b)\hat{}2+1]+\mathrm{Pp}$$

Sv—overburden pressure—derived from integrated bulk density logs

SH—maximum horizontal stress—derived for field analysis

Pp—pore pressure—derived from diagnostic formation inject tests (DFIT) or obtained from pressure gradients provided by reservoir/production engineering UCS—unconfined compressive strength—assumed that UCS and ARSL are essentially identical—obtained from drilling simulation modelling b—rock failure angle—taken from published triaxial compressive tests for various rock material)—in this case pure coal.

Tables describing rock strength for pure sands, shales, coals, etc. exist. Tables describing mixtures of same do not so far as the inventor is aware. Laboratory work based on actual core analysis must be performed.

In an effort to assure fractures created during the stimulation process are orthogonal to wellbore direction, horizontal wells can be drilled on an azimuth equal to minimum horizontal stress. Because tangential hoop stress is therefore at a maximum and radial stress (a function of hydrostatic head and therefore mud density) is at a minimum, wellbore stress conditions can be affected by change in mud density. A spreadsheet was developed which relates the input parameters above with change in mud density. The goal was to develop a simple to follow graph which relates UCS (ARSL) with mud density. The driller simply needs to compare ARSL data obtained during the drilling process with current mud density data. If the intersection of the two values fall below the fitted line, wellbore collapse will likely occur (danger)—if the intersection of the two values appears above the line, wellbore stability should be prevalent. It should be noted that the propensity to increase mud weight well into the "safe" zone also comes at a cost—as mud density is increased rate of penetration decreases—under certain conditions quite dramatically.

Linear Elastic Failure Criterion

Example:

ARSL=35 MPa, mud density=1100 kg/m3 . . . wellbore collapse likely (danger)

ARSL=35 MPa, mud density=1200 kg/m3 . . . wellbore collapse unlikely (safe)

Linear elastic borehole stability analysis can be performed on horizontal wells

A spreadsheet was developed based on Fjaer's equation and the available field data Analysis indicate that coal will fail if the ARSL value is below 40 Mpa in a horizontal well and MW is 1100

Analysis indicate that coal will fail if the ARSL value is below 45 Mpa in a horizontal well and MW is 1050

It is recommended to closely evaluate the ARSL while drilling in conjunction with geological cutting analysis to potentially provide stability warnings in coaly formations To further constrain the in-situ stress tensor, multiple leak-off data should be obtained from deviated wellbores and solved in an inversion routine.

If the minimum in-situ stress indicates a distinct lower value in a formation versus the above and below zones, this will, in that case, indicate that the hydraulic fractures can be isolated within the formation and that they can be long in length without penetrating the surrounding zones. This indicates that there is less but bigger fractures needed to drain the reservoir formation efficiently.

The stability model was constructed to help remove guesswork with regards to required increase in mud density. The model must still be calibrated to handle mixed lithology (and therefore different strength properties).

Symbols

LOT leak-off test $\sigma_v$ overburden stress gradient $\sigma_h$ minimum horizontal stress gradient $\sigma_H$ maximum horizontal stress gradient $\sigma_{tensile}$ tensile rock strength $P_{wf}$ fracture pressure $P_o$ pore pressure In addition to rock strength, MSE (Mechanical Specific Energy) can also be estimated.

Mechanical Specific Energy

The concept of Mechanical Specific Energy is defined as the work required destroying a given volume of the rock. The MSE surveillance process provide the ability to detect changes in drilling efficiency which can help the driller to optimize operating parameters and identifying the system constraints which is a key feature in well planning and operational practice and by definition can be defined as input energy to the output ROP that is the same ratio in Drill-Off test curve specially in linear part that could be the sign of efficient condition during drilling operation. Consequently; the MSE equation in terms of drilling parameters can be shown as:

$$MSE = \frac{WOB}{A_B} + \frac{120\pi \times N \times T}{A_B \times ROP} \tag{21}$$

In the above formula $A_B$ is bit surface area (inch$^2$), N is rotary speed (Round per minute), T is measured Torque (lbf×ft) and MSE in psi (Dupriest 2005, 2006).

It is recognized that the specific energy can not be represented by single accurate value during drilling operation because of wide changes of variables due to the dynamic of drilling and inhomogeneous nature of the rock; whereas approximate mean value can help us to detect any change in drilling efficiency.

In equation (21); measured torque is used as the main variable in the MSE calculation formula. Torque at the bit can be measured by MWD system; also the majority of field data are in the absence of reliable torque measurement. Moreover; some torsional friction may cause significant erroneous readings in real torque measurements. Thereby; bit specific coefficient of sliding friction (μ) is introduced to express torque as a function of the weight on the bit (WOB) and the bit diameter ($D_B$) and let the MSE to be calculated in the absence of reliable torque measurement.

$$T = \mu \frac{D_B \times WOB}{36} \tag{22}$$

Finally; equations (4) and (5) are coupled to form the new form of MSE which is called the modified MSE that can be shown as:

$$MSE_{Mod} = WOB\left(\frac{1}{A_B} + \frac{13.33 \times \mu \times N}{D_B \times ROP}\right) \tag{23}$$

Bit sliding friction coefficient is a constant dimensionless number which is used as around 0.21 for Rollercone and three to five time more for PDC bits as simplicity. For more accurate results; that could be better to obtain the exact bit sliding friction coefficient values using the measured torque and WOB in laboratory measurements (Pessier 1992).

Modified Mechanical Specific Energy for Use in Hydraulic Fracturing

In this patent the WOB is now changed with DWOB obtained from the drill string drag analysis which is the actual weight on bit seen at the bit.

$$MSE_{Mod} = DWOB\left(\frac{1}{A_B} + \frac{13.33 \times \mu \times N}{D_B \times ROP}\right) \tag{24}$$

This models now account for the a new drill bit, perfect bit cleaning and is confined to the level of overbalance seen by the hydrostatic pressure in the wellbore over the pore pressure for permeable rocks and for the confinement of the hydrostatic pressure in the wellbore if the rocks are impermeable.

Modifying this equation for drill bit wear and hydraulics can be done by the use of the normalized hydraulic and wear functions defined for the different drill bit models so that the confine MSE values now become.

$$MSE_{Mod} = W_f \times h(x) \times DWOB\left(\frac{1}{A_B} + \frac{13.33 \times \mu \times N}{D_B \times ROP}\right) \tag{25}$$

Where the normalized functions h(x) and $W_f$ are the same as defined for the different bit ROP models.

The $MSE_{Mod}$ is the confined MSE and need to be correlated to a rock material property and this is done through the normalization of the confining pressure (overbalance) effect as for the rock strength in the ROP models $$MSE_{Mod} = MSE_{Ref} \times (1.0 + a_s \times P_e^{b_s}) \tag{26}$$

Or $$MSE_{Ref} = MSE_{Mod}/(1.0 + a_s - P_e^{b_s}) \tag{27}$$

The $a_s$ and $b_s$ are lithology determined constants and the $P_e$ is the confining pressure of the rock seen at the bit and is defined as $$P_e = P_{Hyd} - P_{Pore} \tag{28}$$

where $P_{Hyd}$ is the hydrostatic pressure in the wellbore at the bit and $P_{Pore}$ is the pore pressure seen under the bit. If the rock is permeable the actual pressure is equal to $P_{Hyd}$ minus $P_{Pore}$ and if the rock is impermeable the $P_{Pore}$ is assumed to be zero so that $P_e$ is equal to $P_{Hyd}$.

This can also be done using the normalized correlation from for the situations when underbalanced drilling is performed. This is when the hydrostatic pressure is less than that of the pore pressure and $P_e$ is negative. The equation utilized is;

The $MSE_{ubd}$ is what the bit sees when drilling underbalanced and the $MSE_{ref}$ is the MSE at an equivalent confining pressure of zero value for $P_e$. This is then the reference MSE at zero confinement and is a rock material property. a' is a specifically calibrated rock property for that specific rock type.

$$MSE_{UBD} = \left(\frac{2}{3}\right) \times MSE_{Ref} \times \exp(-a' \times P_e) + \left(\frac{1}{3}\right) MSE_{Ref} \tag{29}$$

The procedure to determine the MSE profile is as done for the ROP models. If the bit wear coefficient is known the $MSE_{Ref}$ can then be determined directly in that $W_f$ can be predicted while drilling ahead. If now wear coefficient is known for the bit the $MSE_{Ref}$ can be determined iteratively as done for the ROP models, assuming a very small initial wear coefficient and iteratively match the field reported bit wear with the bit wear if the $W_f$ function.

The $MSE_{Ref}$ profiles in the wells can be used to determine the location of where to hydraulically fracture the well.

In an embodiment, rock strength or $MSE_{Ref}$ can be estimated while drilling a first well and drilling or fracturing parameters may be set for a second well according to the rock strength or $MSE_{Ref}$ estimated for the first well. In an embodiment where an autodriller is used, parameters may be set automatically in the autodriller based on the estimated rock strength or $MSE_{Ref}$.

Immaterial modifications may be made to the embodiments described here without departing from what is covered by the claims. In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

What is claimed is:

1. A method of drilling a well or fracturing a formation drilled by a well, the method comprising the steps of:

drilling through rock with a drilling system by rotating a drill bit;

estimating a friction force on the drillstring using a friction model;

estimating a downhole weight on bit using a surface measurement and the estimated friction force;

providing a penetration model for calculating the rock mechanical properties and/ or specific energy using rate of penetration of the bit through the rock formations being drilled, the penetration model including a parameter the strength of the rock and known or estimated parameters, the known or estimated parameters including the estimated downhole weight on bit;

measuring or estimating a value ROP of the rate of penetration of the bit;

given the known or estimated parameters, determining a value CCS of the parameter representing the strength of the rock required to cause the penetration model to calculate the rate of penetration of the bit to have the measured or estimated value ROP;

estimating the strength of the rock according to the value CCS; and setting drilling or fracturing parameters according to the estimated rock strength.

2. The method of claim 1 in which the known or estimated parameters include a rotational speed of the bit.

3. The method of claim 1 in which the known or estimated parameters include a wedge angle of the bit.

4. The method of claim 1 in which the known or estimated parameters include an estimate of a hydraulic level.

5. The method of claim 4 in which the model for calculating the rate of penetration of the bit comprises a proportionality of the rate of penetration to a function of an estimate of the hydraulic level.

6. The method of claim 5 in which the function of the hydraulic level is proportional to a power of a ratio of the hydraulic level to the rate of penetration with sufficient hydraulic level for full cleaning.

7. The method of claim 6 in which the function of the hydraulic level is set to 1if it would otherwise be greater than 1.

8. The method of claim 1 in which the drilling or fracturing is a drilling process conducted by an autodriller.

9. The method of claim 1 in which the rock strength is estimated while drilling a first well and the step of setting drilling or fracturing parameters according to the estimated rock strength comprises setting drilling or fracturing parameters for a second well.

10. The method of claim 1 in which the known or estimated parameters include a measure of bit wear.

11. The method of claim 10 in which the model includes a proportionality of the rate of penetration of the bit through the rock to a function of the measure of bit wear; the method further comprising the steps of:

estimating a rate of change of the measure of bit wear based on the estimated strength of the rock;

repeating the steps of measuring or estimating a value of the rate of penetration of the bit, estimating the strength of the rock, and estimating a rate of change of the measure of bit wear at at least a subsequent point in time, estimating the measure of bit wear at the at least a subsequent point in time using the estimated rate of change of the measure of bit wear; and setting drilling or fracturing parameters according to an estimated rock strength based on the estimate of the measure of bit wear at the at least a subsequent point in time.

12. The method of claim 11 in which the function of the measure of the bit wear is the difference between unity and a constant of proportionality times a power of the measure of the bit wear.

13. The method of claim 11 in which the rate of change of the measure of the bit wear is estimated as proportional to the rock strength.

14. The method of claim 11 in which the rate of change of the bit wear is estimated as proportional to the weight on bit.

15. The method of claim 11 in in which the rate of change of the bit wear is estimated as proportional to a power of the rotational speed of the bit.

16. The method of claim 1 in which the model for calculating the rate of penetration of the bit comprises a proportionality of the rate of penetration to a product of powers of one or more of the known or estimated parameters and the strength of the rock.

17. A method of drilling a well or fracturing a formation drilled by a well, the method comprising the steps of:

drilling through rock with a drilling system by rotating a bit;

estimating a friction force on the drillstring using a friction model;

estimating a downhole weight on bit using a surface measurement and the estimated friction force;

providing a penetration model for calculating the mechanical specific energy of the rock being drilled through, the penetration model including a rate of penetration of the bit, the estimated downhole weight on bit and a hydraulic efficiency of the bit;

measuring or estimating a value of the rate of penetration of the bit and a value of the hydraulic efficiency of the bit;

estimating the mechanical specific energy by applying the penetration model to the measured or estimated value of the rate of penetration of the bit, estimated downhole weight on bit, and value of the hydraulic efficiency of the bit; and setting drilling or fracturing parameters according to the estimated mechanical specific energy.

18. The method of claim 17 in which the model for calculating the mechanical specific energy of the rock being drilled through comprises a proportionality of the rate of penetration to a product of powers of one or more of the known or estimated parameters and the strength of the rock.

19. The method of claim 17 in which the model also includes a wear function of the bit, and the method further comprises measuring or estimating the wear function of the bit, and the step of estimating the mechanical specific energy includes applying the model to the measured or estimated value of the wear function of the bit.

* * * * *